US012698626B2

(12) United States Patent
Schambach et al.

(10) Patent No.: US 12,698,626 B2
(45) **Date of Patent: *Aug. 4, 2026**

(54) BUILDING SYSTEM AND METHOD THEREOF

(71) Applicant: BAHLER IP, LLC, Remington, IN (US)

(72) Inventors: Alan Schambach, Remington, IN (US); Kenneth Culbreth, Remington, IN (US)

(73) Assignee: BAHLER IP, LLC, Remington, IN (US)

( * ) Notice: Subject to any disclaimer, the term of this patent is extended or adjusted under 35 U.S.C. 154(b) by 216 days.

This patent is subject to a terminal disclaimer.

(21) Appl. No.: 18/469,202

(22) Filed: Sep. 18, 2023

(65) Prior Publication Data

US 2024/0003130 A1 Jan. 4, 2024

Related U.S. Application Data

(63) Continuation-in-part of application No. 17/584,535, filed on Jan. 26, 2022, now Pat. No. 11,761,196, (Continued)

(51) Int. Cl.

| | |
|---|---|
| ***E04B 1/35*** | (2006.01) |
| ***E04B 1/344*** | (2006.01) |
| ***E04G 21/32*** | (2006.01) |

(52) U.S. Cl.

CPC ..... *E04B 1/3511* (2013.01); *E04B 1/344* (2013.01); *E04G 21/3266* (2013.01); *E04B 2001/3588* (2013.01)

(58) Field of Classification Search

CPC ..... E04B 1/3511; E04B 1/344; E04B 2001/3588; E04B 1/35; E04B 1/3445; (Continued)

(56) References Cited

U.S. PATENT DOCUMENTS 1,418,510 A * 6/1922 Orion ..... E04B 1/348 52/745.2
1,632,965 A * 6/1927 Hays ..... E04H 12/2215 256/DIG. 5

(Continued)

FOREIGN PATENT DOCUMENTS

DE 802594 C * 2/1951 ..... E04B 1/24
DE 815081 C * 9/1951 ..... E04B 1/344

(Continued)

*Primary Examiner* — Brian D Mattei
*Assistant Examiner* — Joseph J. Sadlon
(74) *Attorney, Agent, or Firm* — Maginot, Moore & Beck, LLP

(57) ABSTRACT

A roof assembly having a fully assembled support assembly that is hingedly coupled to a portion of the top members of the roof assembly. The support assembly can pivotably rotate downward around an edge of the roof assembly and under the roof assembly when the roof assembly is lifted from a first position to a second position. A removeable safety net system can be coupled to a plurality of support members. The columns have a hinge connection to the roof assembly. Upon the roof system being lifted, the hinged columns can fold under the roof system and then be coupled to one or more anchor points established in the ground. The roof system can be raised into position at a pre-determined height using a lifting apparatus, such as a hydraulic lift.

19 Claims, 44 Drawing Sheets

Related U.S. Application Data which is a continuation of application No. 16/699,549, filed on Nov. 29, 2019, now Pat. No. 11,242,680.

(60) Provisional application No. 62/773,814, filed on Nov. 30, 2018.

(58) Field of Classification Search

CPC ..... E04B 1/3441; E04B 1/34384; E04G 21/3266; E04G 21/3214; E04G 21/3261; E04G 21/3204; E02D 27/42; E04H 6/025; E04H 12/2215; E04H 12/187; E04H 15/34

USPC ..... 52/123.1

See application file for complete search history.

(56) References Cited

U.S. PATENT DOCUMENTS 1,758,389 A * 5/1930 Bushnell ..... E04H 12/34 52/745.18
2,260,369 A * 10/1941 Ebenhack ..... E04B 1/3441 52/73
2,307,126 A * 1/1943 Kneisley ..... E04D 13/1637 446/87
2,605,540 A * 8/1952 Kroll ..... E04H 7/06 29/469
3,052,249 A * 9/1962 Seaman ..... E04H 15/00 135/117
3,052,449 A * 9/1962 Long ..... E04B 1/3511 52/125.1
3,119,402 A * 1/1964 Bleick ..... E04H 15/28 135/142
3,404,496 A * 10/1968 Ballard ..... E04B 7/24 52/64
3,630,474 A * 12/1971 Minor ..... E01F 9/635 404/9
3,653,169 A * 4/1972 Jenner ..... E02D 27/01 52/298
3,831,902 A * 8/1974 Vanderklaauw ..... E04B 1/3505 254/105
3,863,419 A * 2/1975 Hendrich ..... E04B 7/24 446/478
3,880,405 A * 4/1975 Brueske ..... E04G 21/3285 248/237
3,924,366 A * 12/1975 Gibbs ..... E04B 7/163 52/143
3,949,532 A * 4/1976 Jonsson ..... B32B 5/245 52/270
3,968,618 A * 7/1976 Johnson ..... E04B 1/3441 52/125.4
4,073,099 A * 2/1978 Van Der Lely ..... E04B 1/3441 52/92.1
4,079,559 A * 3/1978 Tenbrummeler ..... E02D 27/42 248/534
4,162,595 A 7/1979 Ramos
4,216,633 A * 8/1980 Grauer ..... E04B 7/24 52/749.12
4,404,980 A * 9/1983 Wade ..... E04H 15/36 D25/19
4,481,743 A * 11/1984 Jellen ..... E02D 27/00 52/745.11
4,558,713 A * 12/1985 Hagler ..... E04H 15/34 135/159
4,635,412 A * 1/1987 Le Poittevin ..... E04B 1/3442 52/79.5
4,679,374 A * 7/1987 Boehmig ..... E04B 1/35 52/745.03
4,827,958 A * 5/1989 Cantwell ..... E04H 15/425 135/156
4,831,807 A * 5/1989 Bolt ..... E04C 3/17 403/53
4,926,591 A * 5/1990 Buijs ..... E04B 1/3447 52/63
4,962,828 A * 10/1990 Duncan ..... E04G 21/3266 182/138
5,038,532 A * 8/1991 Shahinpoor ..... E04B 1/3441 52/109
5,067,586 A * 11/1991 Myers ..... E04G 5/041 248/237
5,165,499 A * 11/1992 Bell ..... E04G 21/3261 182/9
5,259,479 A * 11/1993 St-Germain ..... E04G 1/20 182/146
5,371,993 A * 12/1994 Saito ..... E04G 21/16 52/745.1
5,406,764 A * 4/1995 Van Auken ..... E04D 12/00 52/63
5,417,018 A * 5/1995 Matsumoto ..... E04G 21/167 52/749.1
5,417,539 A * 5/1995 van der Wal ..... B60P 3/00 280/483
5,461,832 A * 10/1995 Smith ..... E04B 1/3444 52/143
5,645,395 A * 7/1997 Huang ..... B66C 23/24 212/199
5,653,066 A * 8/1997 Schildge, Jr. ..... E04B 7/14 52/6
5,771,991 A * 6/1998 Fresco ..... E04G 21/3214 248/235
5,832,676 A * 11/1998 Gillmore ..... E04B 1/34815 248/669
5,862,826 A * 1/1999 Gremont ..... E04H 15/58 135/159
6,003,629 A * 12/1999 Cloutier ..... E04G 3/28 248/237
6,009,674 A * 1/2000 Root ..... E04H 9/024 52/169.9
6,053,281 A * 4/2000 Murray ..... E04G 21/3223 248/237
6,243,992 B1 * 6/2001 Gyllenhammar ..... B60P 3/34 296/26.05
6,430,887 B1 * 8/2002 Daudet ..... E04C 3/005 52/645
6,446,411 B2 * 9/2002 Natelli, Jr. ..... E01F 9/675 52/843
6,691,488 B2 * 2/2004 Branson ..... E04B 7/022 52/645
6,715,254 B2 * 4/2004 Regular ..... E04D 13/12 52/24
7,127,868 B2 * 10/2006 Purvis ..... E04G 5/041 52/749.12
7,243,473 B2 * 7/2007 Terrels ..... E04C 3/32 52/843
7,469,506 B2 * 12/2008 Hosey ..... E04B 7/166 52/72
7,793,466 B2 * 9/2010 de Cherance ..... E02D 27/36 52/114
7,828,116 B2 * 11/2010 Vetesnik ..... E06C 7/18 182/115
7,832,178 B2 * 11/2010 Rouse ..... E04C 3/34 52/843
7,913,710 B2 * 3/2011 Bougioukos ..... E04H 15/18 135/94
8,109,363 B2 * 2/2012 Dubbert ..... E04G 21/3219 52/127.2
8,615,965 B2 * 12/2013 Kryger ..... E04H 12/08 52/745.18
8,656,652 B1 * 2/2014 Carrillo ..... E04G 21/3276 52/165
8,833,520 B2 * 9/2014 Pizzolato ..... E02D 29/12 182/113
9,032,689 B2 * 5/2015 Yustus ..... E04H 12/10 52/745.18
9,062,448 B2 * 6/2015 Richardson ..... E04B 1/1903
9,062,451 B1 * 6/2015 Wilson, Jr. et al. ..... B60P 3/40
9,080,326 B2 * 7/2015 Johnson ..... E04B 1/3442
9,175,487 B2 * 11/2015 Iturbe Beristain .... E04G 21/166
9,353,537 B2 * 5/2016 Wensel ..... E04G 23/065
9,441,371 B1 * 9/2016 Harkins ..... E04B 7/18

(56) References Cited

U.S. PATENT DOCUMENTS

| | | | | |
|---|---|---|---|---|
| 9,546,495 | B2 * | 1/2017 | Shiomi | E04B 7/102 |
| 10,240,338 | B2 * | 3/2019 | Durst | F42D 5/045 |
| 10,260,211 | B2 * | 4/2019 | Peterson | E04B 1/24 |
| 11,248,388 | B2 * | 2/2022 | Dingeldein | E04H 7/22 |
| 11,306,492 | B2 * | 4/2022 | Chevis | E04G 11/365 |
| 11,976,481 | B2 * | 5/2024 | Buenemann | E04G 21/3276 |
| 12,071,776 | B2 * | 8/2024 | Pippins | A62B 35/0068 |
| 12,098,537 | B2 * | 9/2024 | Dragan | E04B 1/3511 |
| 2005/0076605 | A1 * | 4/2005 | Giaconi | E04B 1/2403 52/741.1 |
| 2005/0235579 | A1 * | 10/2005 | Hosey | E04B 7/166 52/68 |
| 2006/0213723 | A1 * | 9/2006 | Rexroad | E04G 21/3266 182/138 |
| 2006/0243523 | A1 * | 11/2006 | Curtin | E04G 3/22 182/82 |
| 2009/0013614 | A1 * | 1/2009 | Rogers | B60P 3/34 52/66 |
| 2010/0263299 | A1 * | 10/2010 | Ohnishi | E04B 1/14 52/745.02 |
| 2011/0185643 | A1 * | 8/2011 | Dueker | E04F 10/005 52/74 |
| 2012/0272584 | A1 * | 11/2012 | Bilsen | E04H 3/28 52/7 |
| 2017/0370091 | A1 * | 12/2017 | Dragan | E04B 1/3511 |
| 2020/0347625 | A1 * | 11/2020 | Melic | E04G 21/3266 |
| 2023/0151625 | A1 * | 5/2023 | O'Connor | E04G 1/12 52/123.1 |

FOREIGN PATENT DOCUMENTS

| | | | | |
|---|---|---|---|---|
| DE | 1609500 | A1 * | 9/1970 | E04B 1/3511 |
| DE | 1684262 | B1 * | 12/1970 | E04B 1/3511 |
| DE | 3409823 | A1 * | 9/1984 | E04B 1/92 |
| FR | 1495511 | A * | 9/1967 | E04B 1/344 |
| GB | 191229653 | A * | 10/1913 | E04H 15/52 |
| GB | 2029474 | A * | 3/1980 | E04B 1/344 |
| GB | 2208889 | A * | 4/1989 | E04G 5/041 |
| GB | 2526317 | A * | 11/2015 | B60P 3/341 |
| KR | 101684388 | B1 * | 12/2016 | B66F 1/02 |
| WO | WO-9415041 | A1 * | 7/1994 | E04B 1/24 |
| WO | WO-2007057483 | A1 * | 5/2007 | E04B 1/344 |
| WO | WO-2014186868 | A1 * | 11/2014 | E04G 23/065 |

* cited by examiner

BUILDING SYSTEM AND METHOD THEREOF

CROSS-REFERENCE TO RELATED APPLICATION

This U.S. patent application is a continuation-in-part which claims prior to U.S. patent application Ser. No. 17/584,535 filed on Jan. 26, 2022, which is a continuation application which claims priority to U.S. patent application Ser. No. 16/699,549 filed on Nov. 29, 2019, which claims priority to U.S. Provisional Application 62/773,814 filed Nov. 30, 2018, the disclosure of which is considered part of the disclosure of this application and is hereby incorporated by reference in its entirety.

FIELD OF THE INVENTION

This invention relates generally to the construction of buildings and specifically to those that utilize pre-manufactured components applied to a modified building skeleton resulting in an improved building. In one aspect, the present disclosure is related to an apparatus and method of constructing a building that improves the safety and efficiency of constructing such building.

BACKGROUND

Post-frame buildings, which evolved from so-called pole barns, are used for a wide variety of commercial, industrial, and agricultural purposes, for they are, compared to other types of construction, relatively easy and inexpensive to erect. In this regard, the typical post-frame building has a series of wooden posts or columns along its perimeter, with these columns being set into the earth or onto a concrete foundation The columns are tied together by horizontal members, called girts, and support wooden roof trusses which are joined together with purlins. Bracing is also normally incorporated into the structure. The trusses in turn support a lightweight roofing, and similarly the girts have a suitable siding material attached to them.

Other conventional building construction methods have focused on the cost and efficiency advantages of having construction mostly manufactured at the manufacturing plants or factories. Current construction techniques that use manufactured housing structures include building modules of a certain room to be delivered to a construction site. Manufactured housing techniques offer some advantages over on-site construction methods. For example, construction for manufactured housing may be carried out year-round regardless of the weather since manufacturing within a factory or plant can occur indoors.

While there have been improvements in building methods and construction systems, many of these methods still create substantial safety risks as they require construction workers to be at high elevations that are at risk of falling off of the building while attaching roofing components. The system and method of the present disclosure can reduce potential fall heights to less than one foot into a net, as opposed to an impact fall with a cable restraint to upwards of about ten to about twenty feet with potential obstructions prior to engagement of the restraint system. The method of the present disclosure reduces corporate safety costs, improves labor efficiency, increases construction crew retention, and increases the building quality. Therefore, there exists a need to provide a construction method and system to protect employees when working on roofs, especially low-eave buildings.

BRIEF SUMMARY OF THE INVENTION

In one aspect, this disclosure is related to a construction method for building a post frame building by first constructing the roof near ground level. The roof assembly can be covered with a removeable safety net system. The roof system can be coupled to one or more columns having a hinge. Upon the roof system being lifted, the hinged columns can fold under the roof system and then be coupled to one or more anchor points established in the ground or suitable alternate foundation systems. The roof system can be raised into position at a pre-determined height using a hydraulically powered lifting apparatus.

In another aspect, this disclosure is related to method of constructing a post-frame building where a roof assembly is first constructed at a first position above ground level. The first position can be proximate to the ground. The roof assembly can be constructed on top of a plurality of stubs/foundations provided prior to constructing the roof assembly. A support assembly can then be constructed, wherein the support assembly can include one or more columns. The support assembly can then be pivotably coupled to the roof assembly. One or more load distributing apparatuses can then be positioned underneath the roof assembly. One or more lifting means can then be coupled to the load distributing apparatus. A control system having a controller with a memory can be communicatively coupled to one or more lifting means. The controller can initiate a lifting protocol to raise the roof assembly from the first position to a second position. Once the roof assembly is positioned in the second position, the support assembly is then pivoted to allow for the bottom of the columns of the support assembly to be coupled to the stubs previously supporting the roof assembly. The load distributing apparatus can be lowered back down and removed. The roof assembly can include one or more top members that can first be removably coupled to a corresponding stub or foundation point when the roof assembly is assembled in the first position. The support assembly can be built near ground level and include columns, girts, and a hinge to couple to the roof assembly prior to lifting the roof assembly to the second position. Prior to lifting the roof assembly, a safety net system can be coupled to the roof assembly. The safety net system can include nets located between trusses and at the leading edges of the roof assembly.

In another aspect, this disclosure is related to post-frame building assembly having a roof assembly, one or more support assemblies that can include pre-constructed walls coupled with the hinges to the roof assembly, and one or more lifting apparatuses to raise the roof assembly to a pre-determined height. The hinged or pivotable coupled walls can be configured to swing under the edges of the roof assembly. Upon the walls being positioned vertically under the roof assembly, the hinged portions can be fastened securely to ensure that the walls do not move out from under the roof assembly. The walls can then be coupled to the ground at pre-determined foundations.

In yet another aspect, this disclosure is related to a building system. The building system is designed to allow for safer construction of a building by including a plurality of stubs and/or foundation points at pre-determined points of a desired building layout. The system can include a roof assembly. The stubs can take any suitable form, including but not limited to, wood, perma-columns, or concrete, and each type interacts with the column top differently. The roof assembly can include a plurality of top members. The top members can be temporarily coupled to the stubs while the remainder of the roof assembly is constructed. The system can further include a support assembly comprised of a plurality of columns. The support assembly can be pivotably coupled to a portion of the roof assembly. The system can use one or more load distributing apparatuses that are designed to support the roof assembly when it is raised from a first position to a second position off of the ground by a lifting apparatus. The load distributing apparatus can include one or more wheel assemblies. The wheel assemblies can have a moveable portion to allow the wheels to be either extended and engaged to allow a user to easily position the load distributing apparatus or in a retraced position when the load distributing apparatus is stationary. The lifting apparatus can be coupled to the load distributing apparatus and can include a control system. The control system can include a controller communicatively coupled to a memory. The memory can include lifting protocols, algorithms, historical data, level thresholds, and other related data. The control system can be communicatively coupled to the lifting apparatus and control a lifting means, such as a hydraulic cylinder to lift the roof assembly from a first position to a second position. The system can further include a safety net system that can be coupled to the roof assembly and the stubs while the roof assembly is being constructed on top of the stubs. The safety net system can further include a tensioning means to maintain the nets of the safety net system in a taught position. The safety net systems can have one or more support members extending outward from the roof assembly, wherein a proximate end of the support member can be coupled to the stub and the distal end can extend out away from the roof assembly.

BRIEF DESCRIPTION OF THE DRAWINGS

The features and advantages of this disclosure, and the manner of attaining them, will be more apparent and better understood by reference to the following descriptions of the disclosed system and process, taken in conjunction with the accompanying drawings, wherein.

DETAILED DESCRIPTION OF THE INVENTION

Figure 1A:
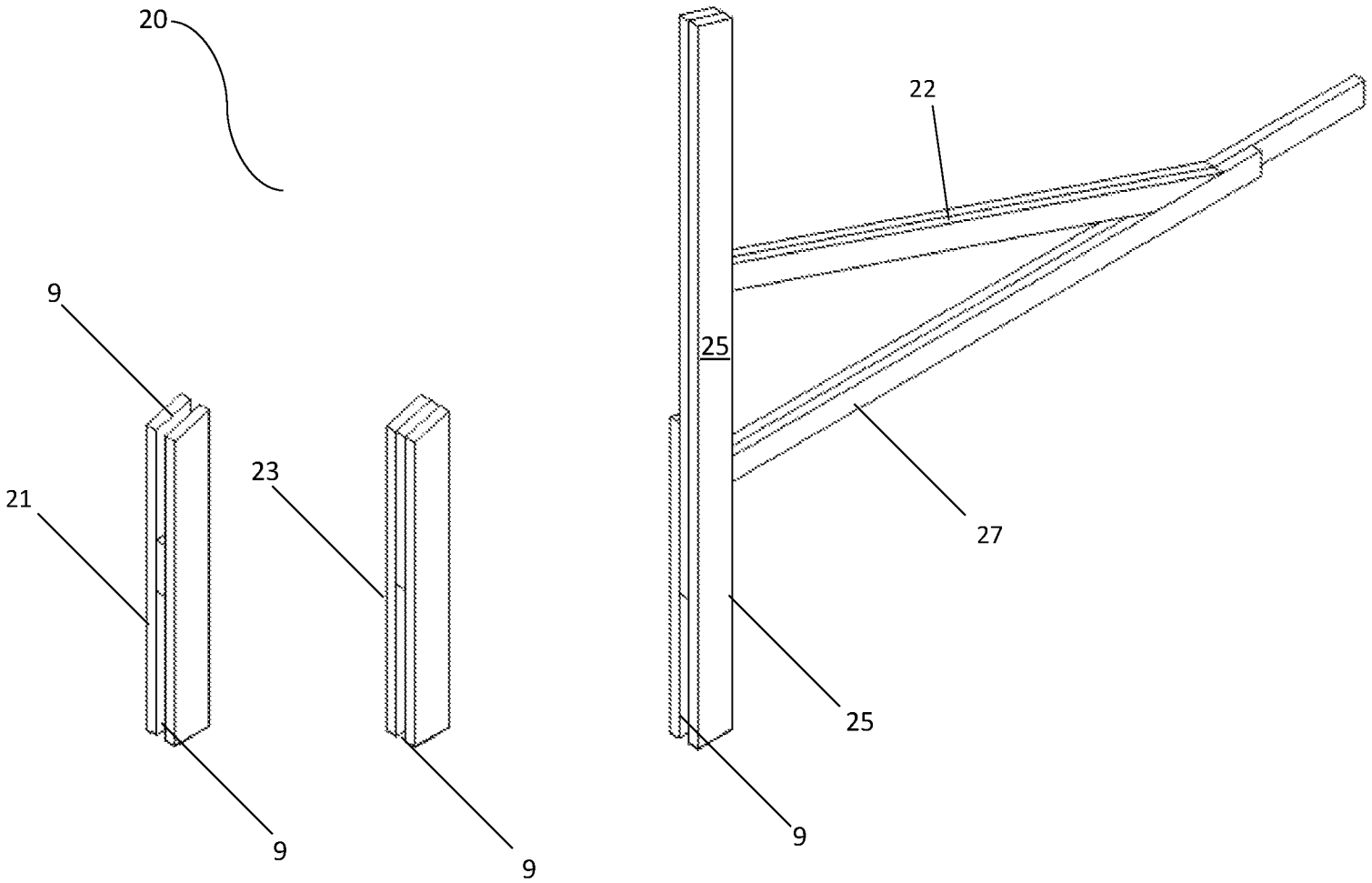
FIG. 1A is an illustration of column supports of an exemplary embodiment of the present disclosure.

The following detailed description includes references to the accompanying drawings, which forms a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention of this disclosure is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s), or step(s), to the objective(s), spirit, or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments, whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful and is not intended to exclude other embodiments from the scope of the invention.

As used herein, the terms "front," "back," "rear," "upper," "lower," "right," and "left" in this description are merely used to identify the various elements as they are oriented in the FIGS., with "front," "back," and "rear" being relative to the apparatus. These terms are not meant to limit the elements that they describe, as the various elements may be oriented differently in various applications.

As used herein, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members, or the two members and any additional intermediate members being attached to one another. Such joining may be permanent in nature or alternatively may be removable or releasable in nature. Similarly, "coupled" can refer to two members or elements being communicatively coupled, wherein the two elements may be electronically coupled, through various means, such as a metallic wire, wireless network, optical fiber, or other medium and methods.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the teachings of the disclosure.

Systems and methods are described herein for constructing buildings, such as new post-frame buildings, that allow for cost-effective site management and improved safety for construction workers on site.

The present disclosure relates to a method of constructing a building while providing additional safety for the construction workers. The construction method can first include preparing and laying out the building design and dimensions. One or more foundation locations can be marked and excavated in order to establish one or more pre-determined foundation locations. In some exemplary embodiments, the foundations can be a solid slab foundation. Alternatively, foundations can be poured foundations for accepting one or more columns. The foundations can be poured on location or can be pre-cast using any suitable material. In one exemplary embodiment, the pre-cast foundations can be made from a composite material that reduces potential deterioration that can be experienced by concrete foundations due to freezing and thawing cycles.

Figure 1B:
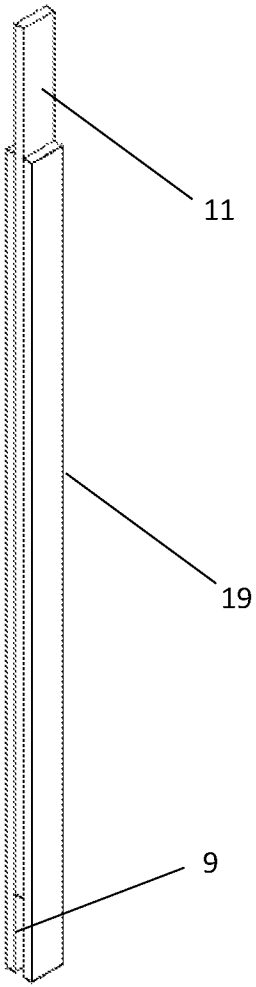
FIG. 1B is an illustration of an exemplary embodiment of a column of the present disclosure.
Figure 1C:
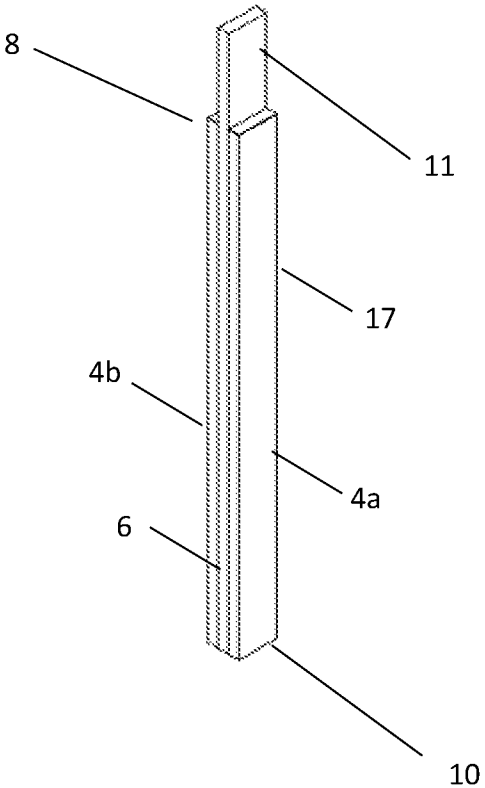
FIG. 1C is an illustration of an exemplary embodiment of a stub support of the present disclosure.

The foundations can then be placed, and the stubs 17 can be set and cut to a predetermined length for receiving a column 19. The stubs can extend up from the ground a pre-determined distance. The columns can have a top end 24 and a bottom end 26. The various construction materials can be staged prior to assembly. The materials can include upper columns, liners, overhang tails, end-fills, wind braces 22, and nets, among other components. As shown in FIG. 1C, the stubs 17 can include a plurality of components. The stubs 17 can be fastened to foundations 40 using any suitable means and can extend out of the ground 50 a predetermined distance. A foundation anchor 42 can be used in certain embodiments. The stubs can have joining means located at one end of the stub which can be coupled to a similar joining means of a column 19 or top member 20. In one exemplary embodiment, the stubs 17 can include two outer portions 4*a,b*, with an inner portion 6 sandwiched between the two outer portions 4*a,b*. The various portions can have a first end 8 and a second end 10. The inner portion 6 can extend a pre-determined distance beyond the edge of the first end of the two outer portions 4*a,b*.

In other exemplary embodiments, the stubs 17 can be formed out of any suitable material such as a polymer, concrete, wood, or composite materials. The stubs 17 can be molded to form a similar junction point wherein an interior portion 6 extends past the plane of the two exterior portions, forming an extension portion 11 that can be used to couple to a corresponding recessed portion 9 of another component such as a column 19 or on of the top members 20, as shown in FIG. 1B and FIG. 1A, respectively. The stubs 17 can be formed in any suitable manner to allow for a coupling between the stub 17 and the column 19, including but not limited to, 2 ply, 3 ply, and any other suitable configurations. Alternatively, in another exemplary embodiment, the stubs 17 can have a recessed portion 9. In other embodiments a different joining feature can be used to couple the stubs 17 to the columns 19 or top members 20. In certain embodiments where the stubs 17, columns 19, and top members 20 are formed into singular pieces, they can be formed in a manner that can include any of the above variations of a recessed portion or extension portion on either end of the stub, column, and/or top members.

In one exemplary embodiment, a column 19 can include a corresponding recessed portion 9 to accept the extension portion 11 of a stub 17. The recessed portion 9 can be configured in a similar manner, wherein the two outer portions sandwich an inner portion between them. Like the stubs, the portions can have a first end and a second end, where in the first end of the outer portions can extend further than the first end of the inner portion as shown in FIG. 1B. Similarly, as stated above, one suitable embodiment can use three or more studs to comprise the outer portions and inner portion. Alternatively, the column can be formed of any suitable material. In some exemplary embodiments, the first end of a column can have a recessed portion 9, while the second end can have an extension portion 11. The columns can be configured in various arrangements as determined by the requirements of the building.

Figure 2:
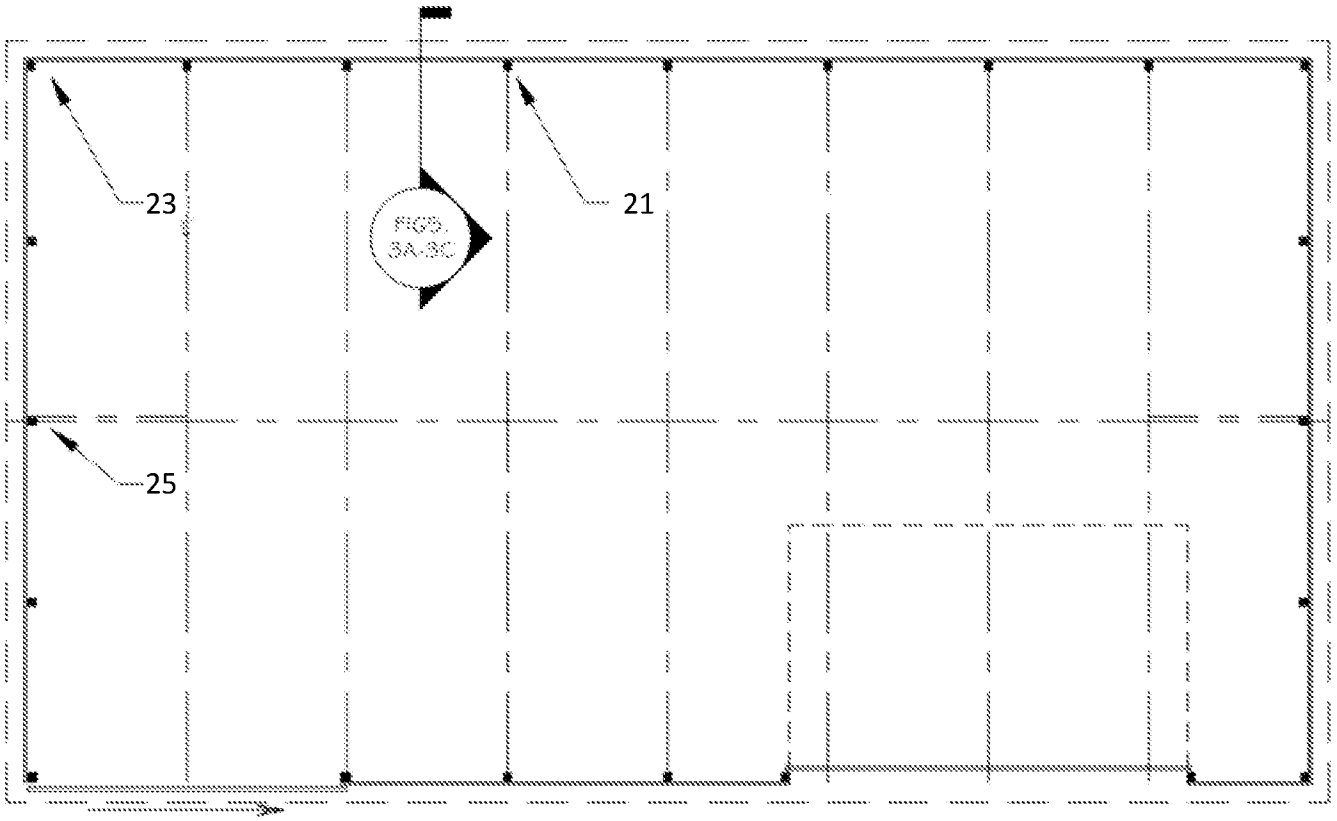
FIG. 2 is an illustration of a key plan for an exemplary embodiment of a construction system of the present disclosure.

The building can also use roof top members 20 that can be configured to couple to both the stubs 17 and columns 19. The various types of top members 20 can include a side top member 21, a corner top member 23, and an end column top member 25. These members 20 are illustrated in FIG. 1A. Similar to the columns 19 and stubs 17, these members can have various arrangements including recess 9 and extension 11 portions. In one exemplary embodiment, the side top member 21 can have a recess formed in both the first and second end. The end column top members 25 can further include additional bracing 27 extending laterally from the vertical support members 26. FIG. 2 illustrates generally the locations of the various roof top members in an exemplary embodiment. The columns 19 can be positioned below the roof members and rest on top of the stubs 17.

Figure 3A:
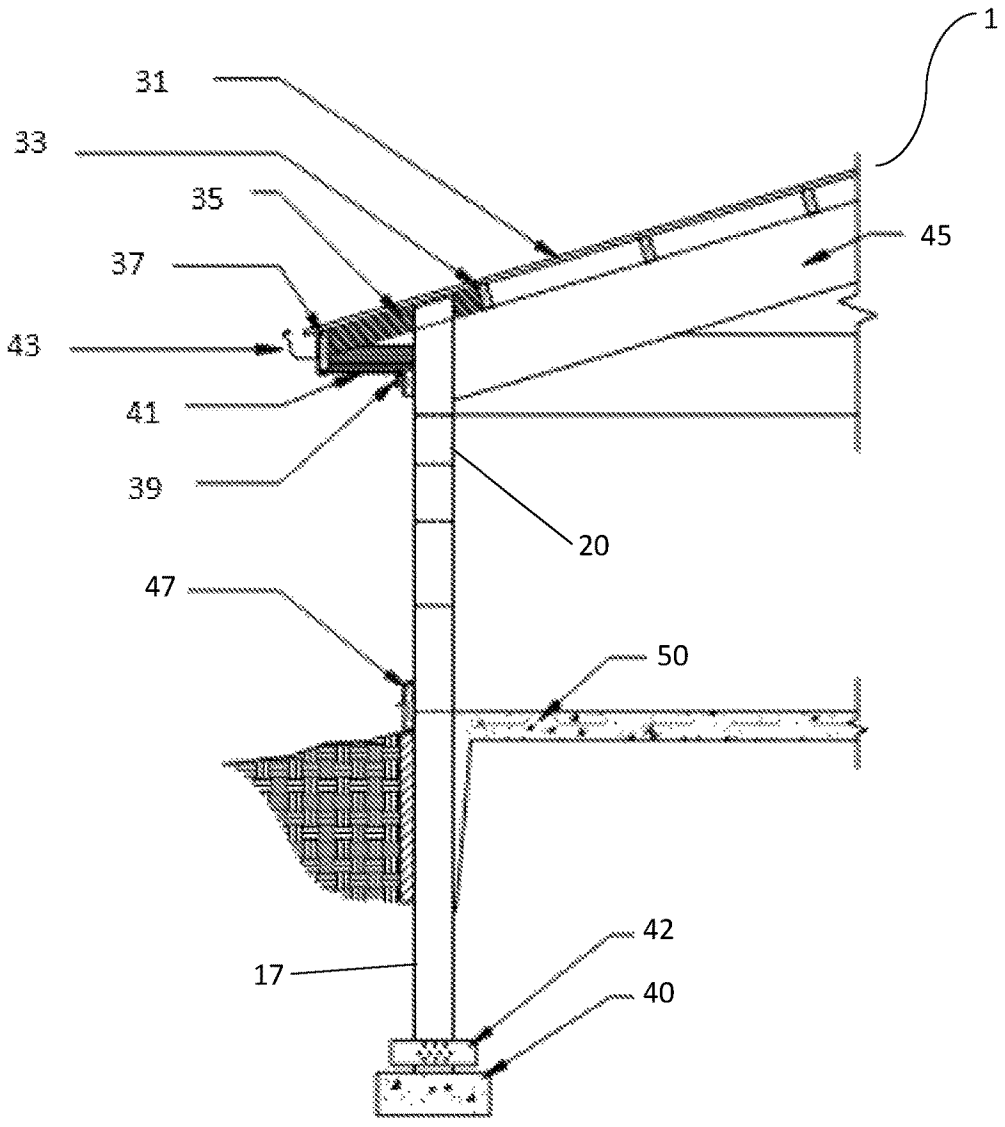
FIG. 3A is an illustration of an exemplary embodiment of ground wall sections of the present disclosure prior to lifting the roof assembly.
Figure 3B:
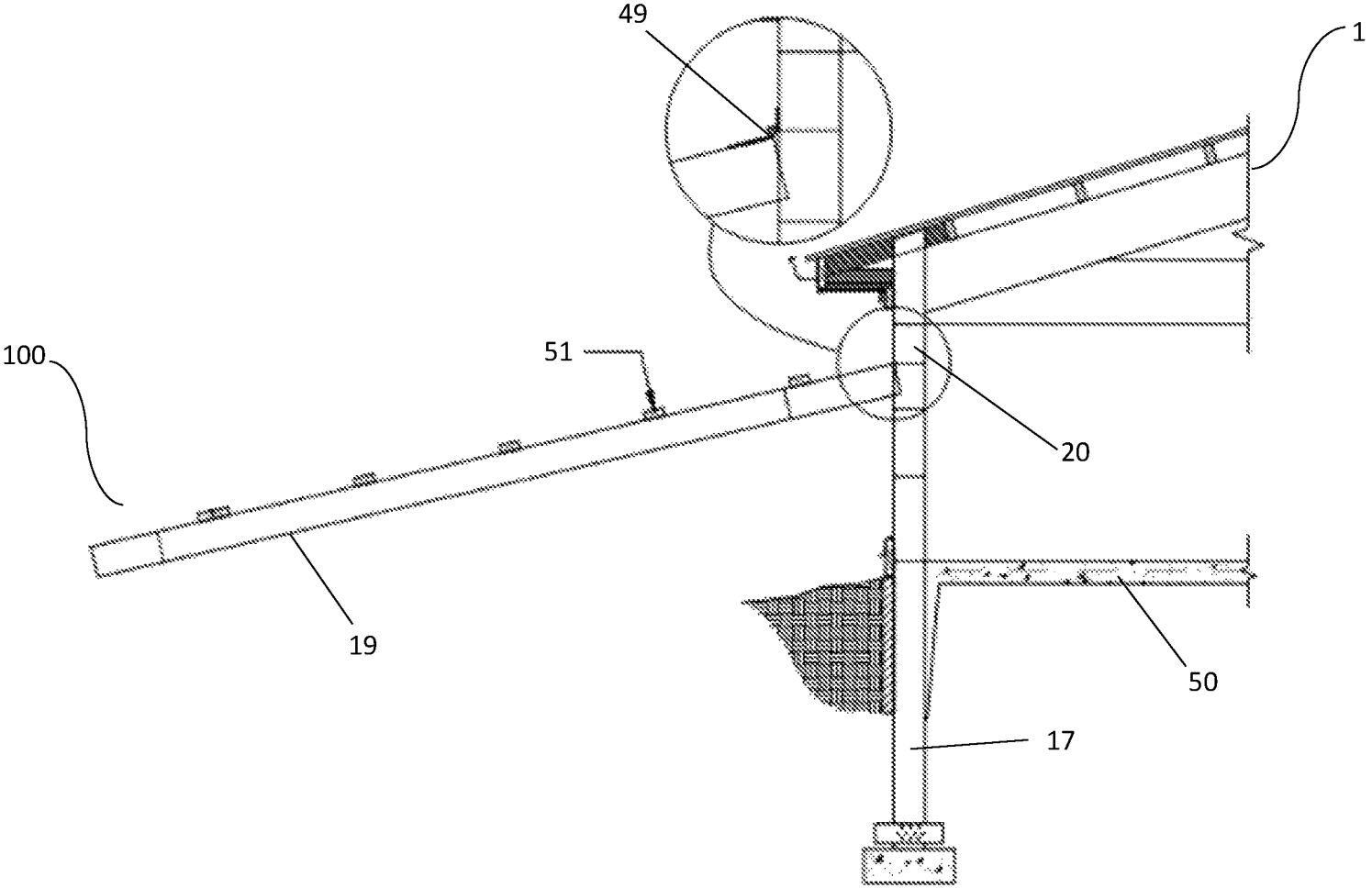
FIG. 3B is an illustration of an exemplary embodiment of a hinged wall section of the present disclosure attached to a roof assembly prior to lifting the roof assembly.
Figure 3C:
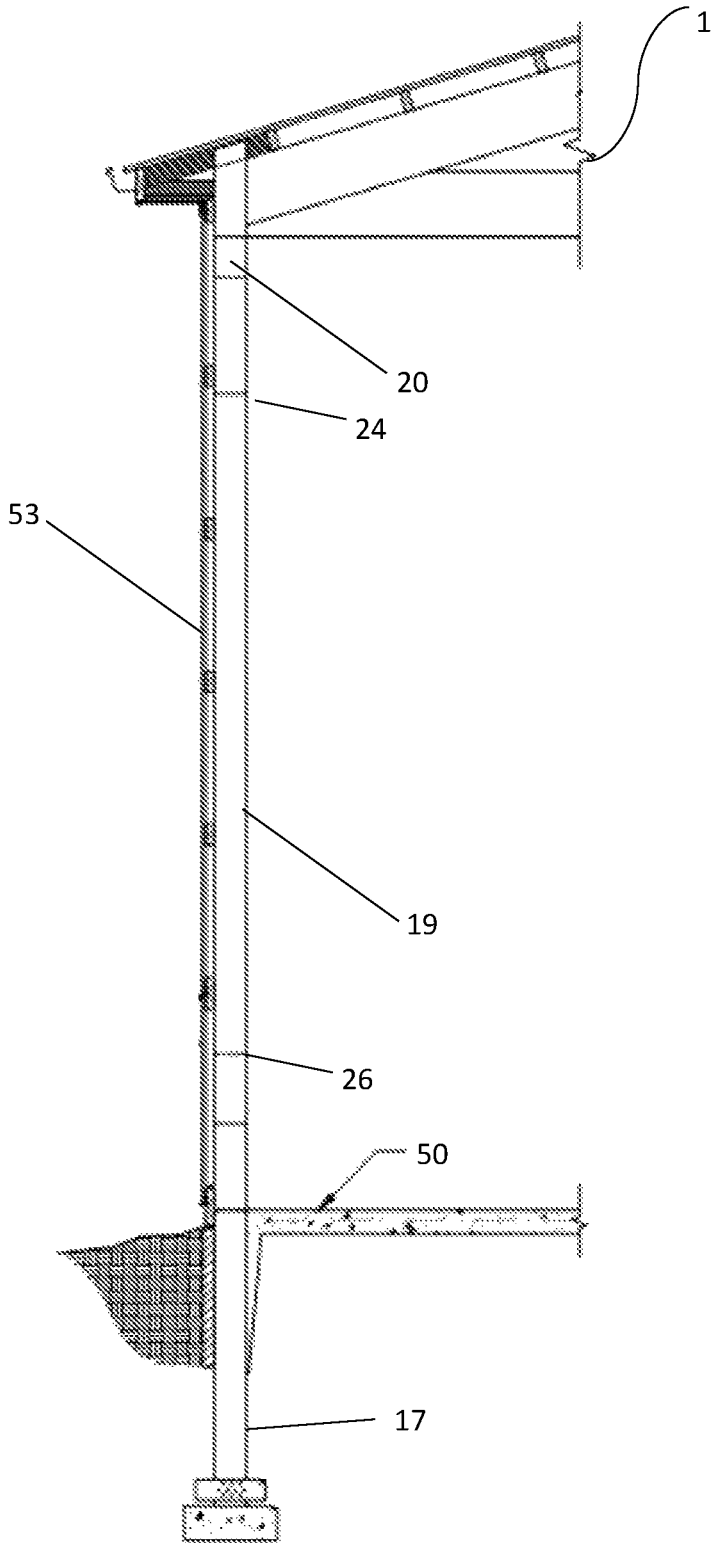
FIG. 3C is an illustration of the hinged wall of FIG. 3B after the roof assembly has been raised.

During construction, the roof assembly can first be staged and built upon the stubs as shown in FIG. 3A and FIGS. 15A-C. The top member portions can have the corresponding recesses or protrusions to correlate to the stubs 17. In some exemplary embodiments, the support columns 19 can be coupled to the top members of the roof assembly 1. The roof assembly 1 can be first fully assembled near ground level 50 and can include the roofing material 31, the purlins 33, a pre-framed overhand tail 35, a barge board and fascia 37, top girt channel 39, soffit 41, a gutter 43, and one or more trusses 45. A grade board 47 can be used to shield a portion of the stubs 17. As shown in FIG. 3B, the columns 19 can then be coupled to the first end of the respective top members 20. In one exemplary embodiment, the top member 20 can be coupled to the columns 19 using a hinged means 49, as further illustrated in FIG. 3B. The hinged means 49 can allow for the columns to extend outward in a diagonal or horizontal position, while the roof assembly 1 is still resting upon the stubs 17. The columns 19 can include one or more girts 51 to allow for coupling of an exterior sheathing 53 either before or after the roof assembly 1 is raised into position. The exterior sheathing can include any suitable materials and configuration. FIG. 3C illustrates the building system of the present disclosure, wherein the roof assembly 1 has been raised and the columns have been coupled into place with both the top members 20 and the stubs 17. The columns 19 can be coupled to the stubs 17 using any suitable means such as a fastener.

After column top members 20 and trusses 45 are installed, the liners and a safety net system 700 can be installed. The safety net system 700 can provide a safety system for workers constructing the building, especially the roof components of the building assembly. The safety net system 700 can include intermediate fall protection system 702, wherein a net 701 can be located in between individual trusses 45 of the roof assembly 1 as shown in FIG. 6A-D. One or more clips 703 can be used to couple the net to the roof assembly 1. Additionally, the safety net system 700 can include a leading-edge fall net system 704 at the leading edges of the roof assembly shown in FIG. 5. The safety net system can be coupled to various aspects of the roof assembly, including but not limited to the trusses 45 and column members 19, as shown in FIGS. 5-6.

Figure 6A:
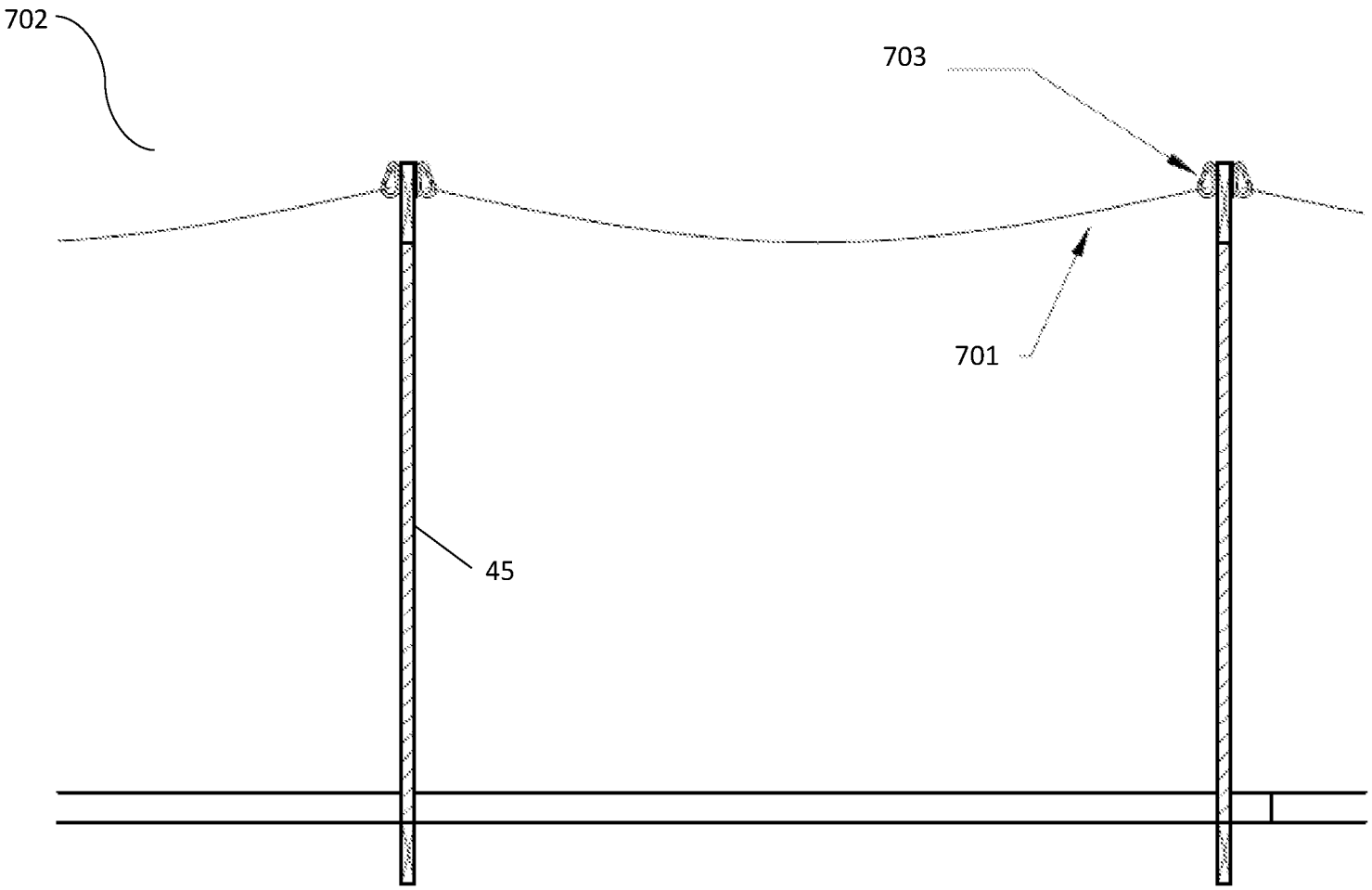
FIG. 6A is an illustration of an exemplary embodiment of a safety net system located between trusses to ensure the safety protection of the users assembling the building.
Figure 6B:
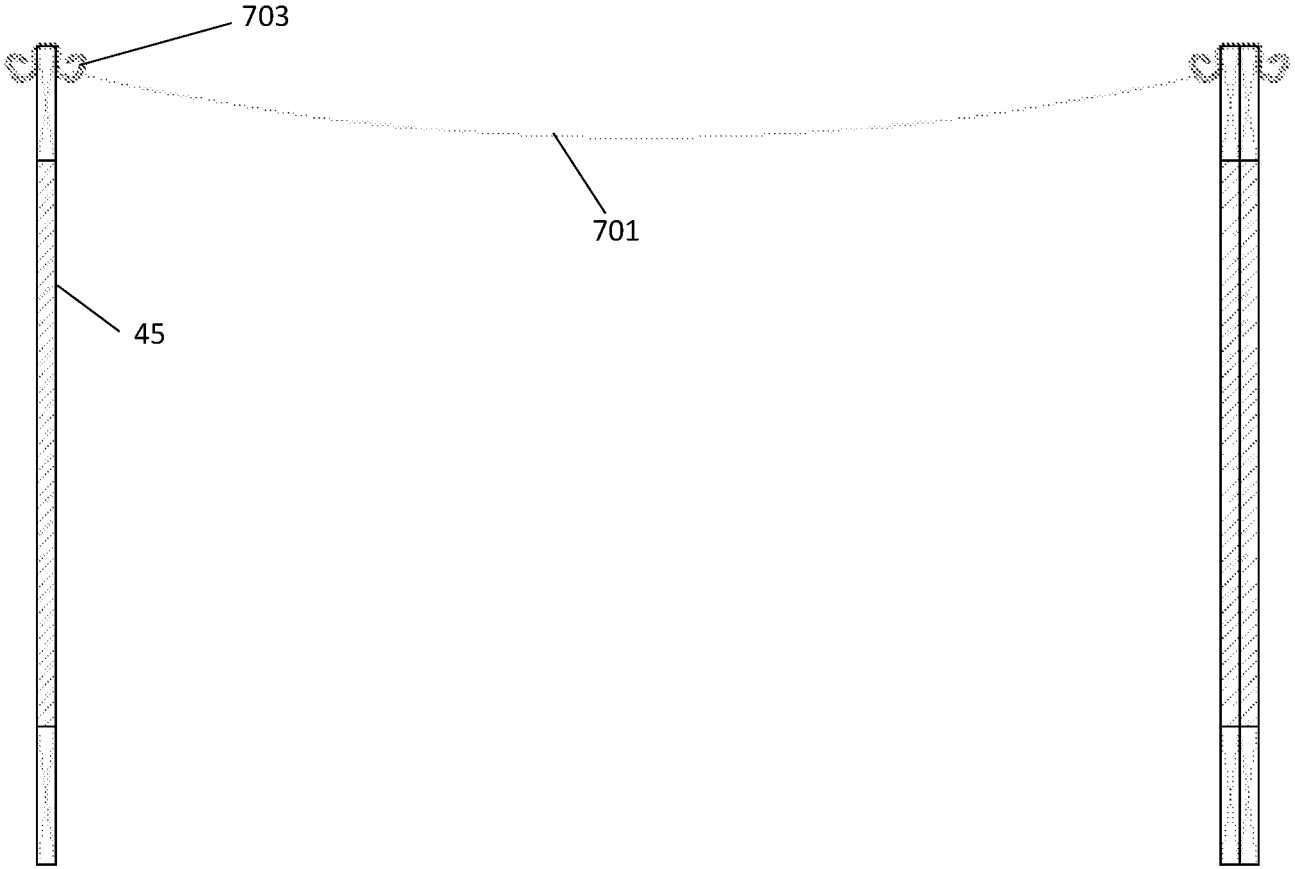
FIG. 6B is an illustration of another exemplary embodiment of a safety net system located between trusses to ensure the safety protection of the users assembling the building.
Figure 6C:
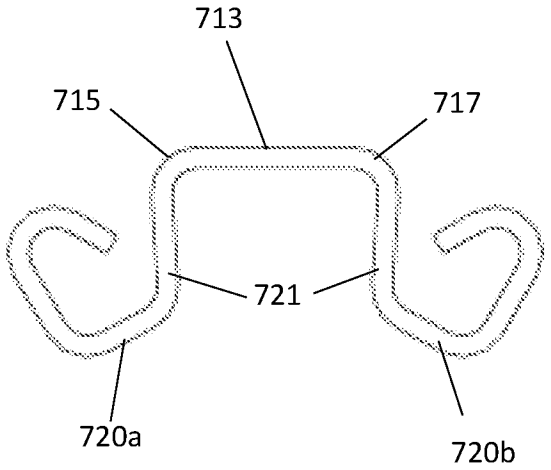
FIG. 6C is an illustration of an exemplary embodiment of a clip of a safety net system located between trusses to ensure the safety protection of the users assembling the building.
Figure 6D:
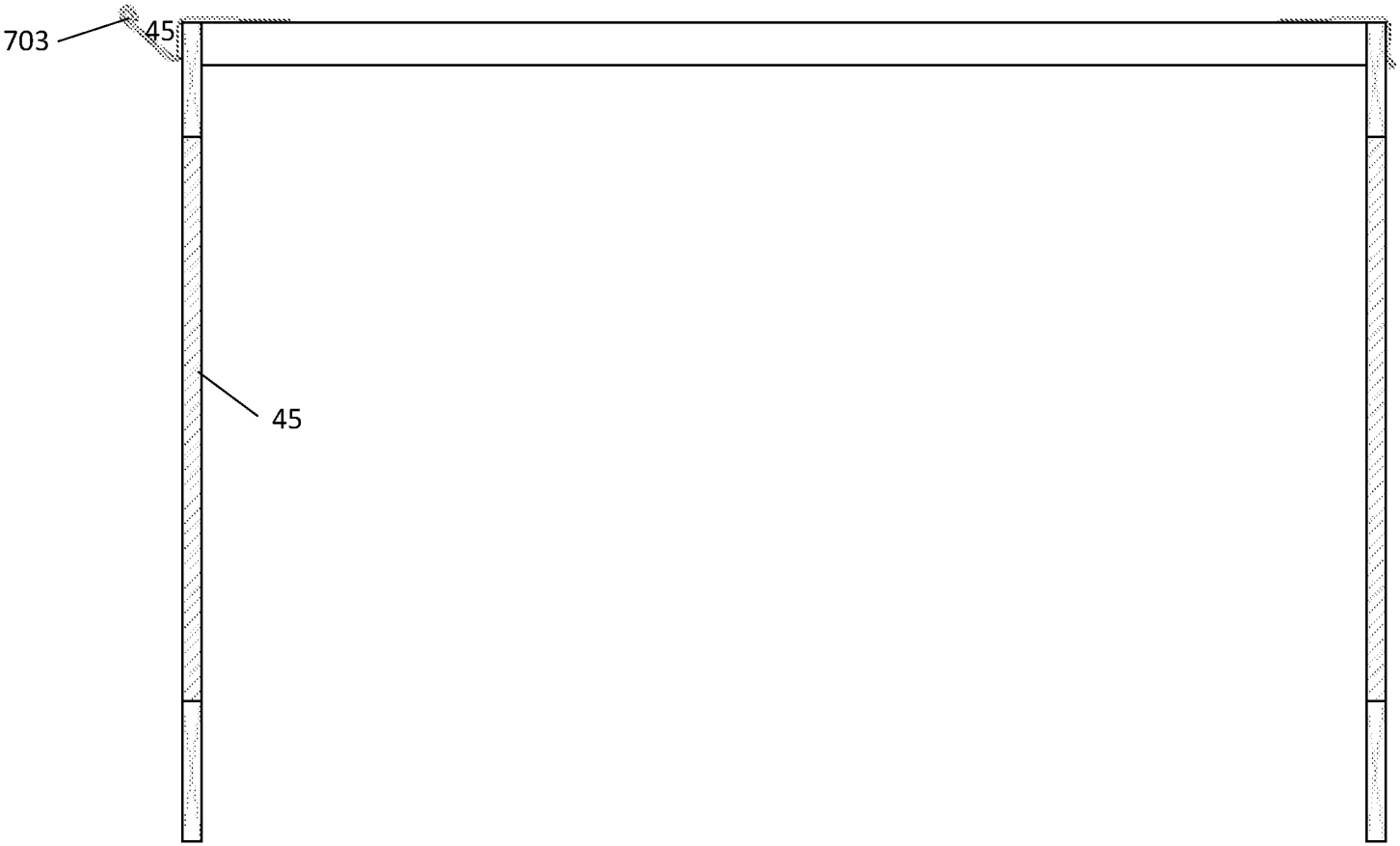
FIG. 6D is an illustration of another exemplary embodiment of a quick-liner system located between trusses to ensure the safety protection of the users assembling the building.

In some exemplary embodiments, the clips 703 can be configured to conform to the width of a truss or beam. The clip can have a first middle section 713 having a first end 715 and a second end 717. At each end of the middle section 713 can be a hook portion 720. The hook portion(s) 720 can be configured to couple the support net to the roof assembly. The middle section 713 of the clips can have various lengths to conform to the width of the supports or trusses. The hook portion 720 can include a portion 721 extending downward from the middle section 713. The portions 721 extending downward can extend and generally be perpendicular with respect to the middle section 713. In some exemplary embodiments, the portions 721 can extend generally downward toward each other at an angle to allow for additional compression against the truss or support member. A safety system can additionally include a quick-liner system as shown in FIG. 6D. A hook element 706 and a clip element 708 can be fastened to each end of a 2×4 to form a quick-liner. This piece allows trusses 45 to be set and locked in place without someone needing to climb on the truss.

Figure 5:
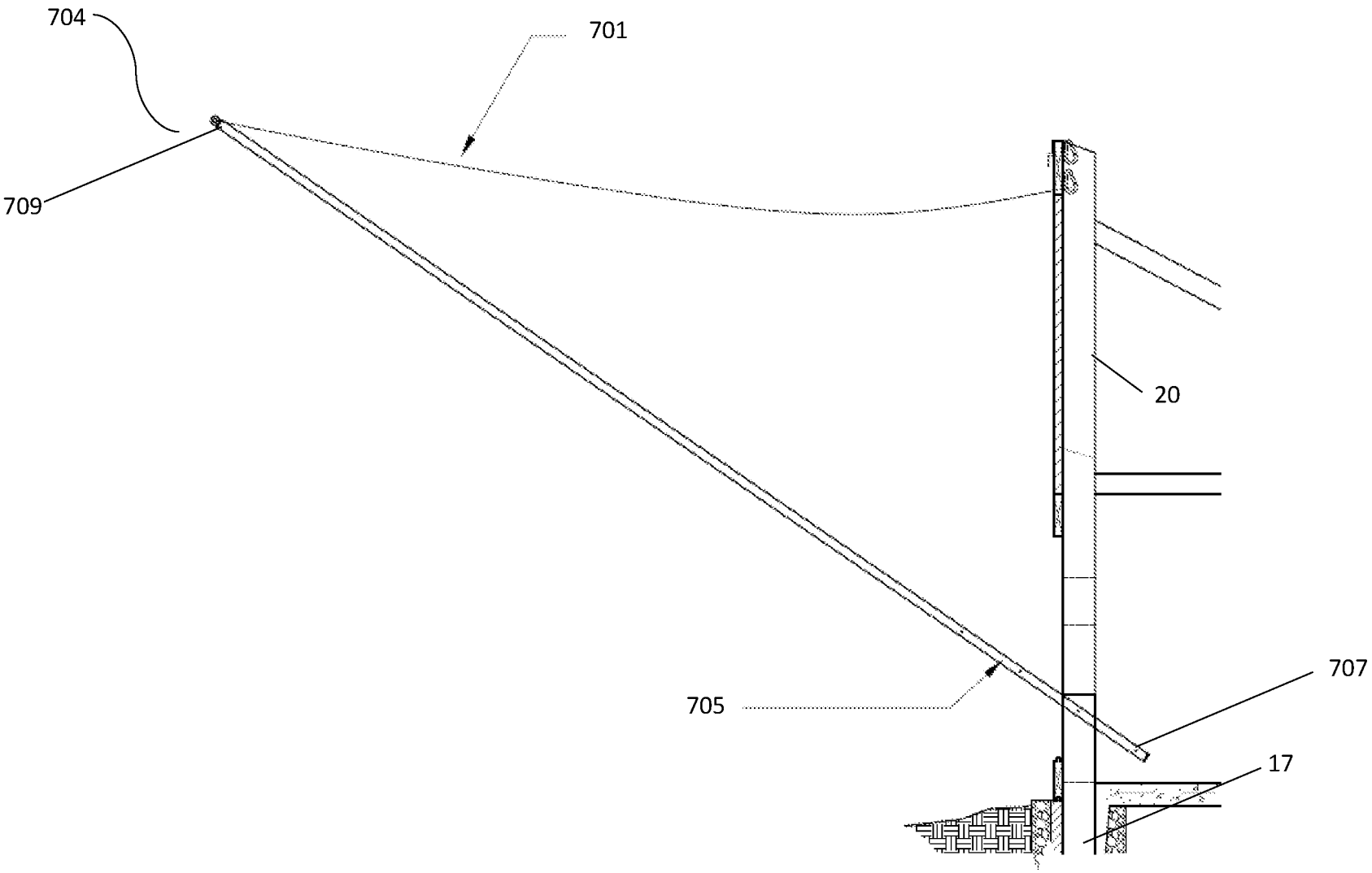
FIG. 5 is an illustration of an exemplary embodiment of a safety net system for leading edge protection and safety of users of the present disclosure.
Figure 7:
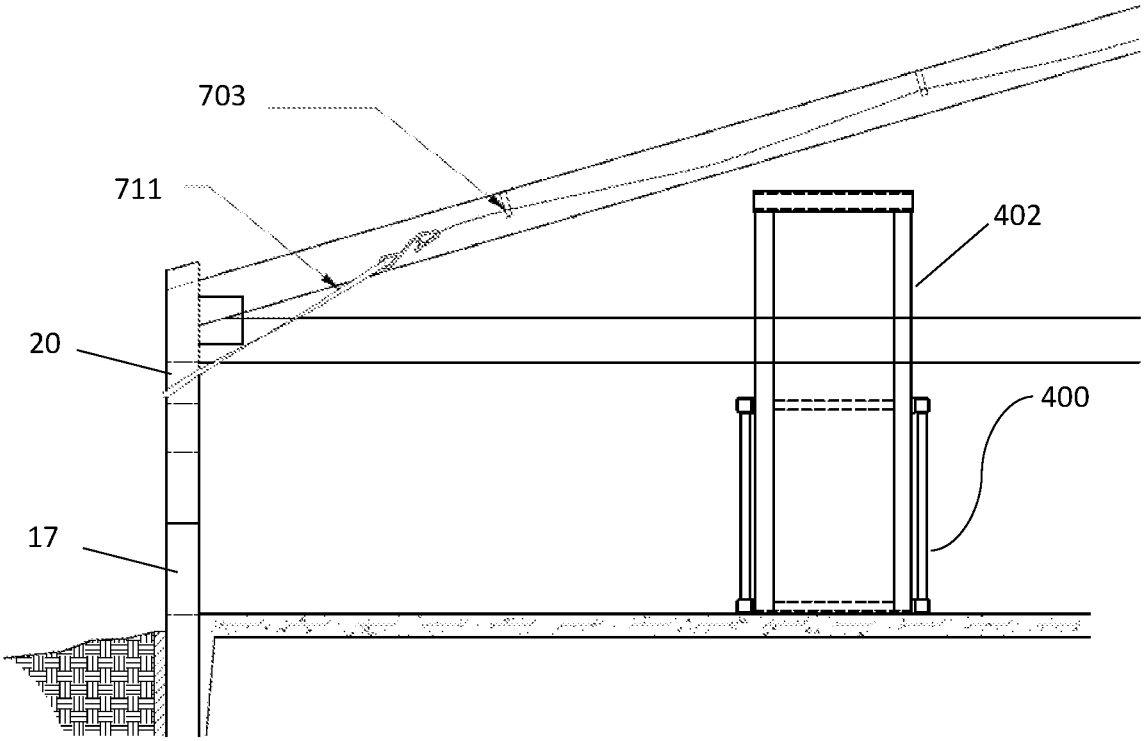
FIG. 7 is an illustration of an exemplary embodiment of a net system and the load distributing apparatus segments positioned under the trusses prior to raising the roof assembly.

Additionally, the net system 700 can have one or more outstretched/diagonal support members 705 having a proximate end 707 and a distal end 709, as illustrated in FIG. 5, for providing a safety system at the leading edges of the roof assembly, thereby providing protection and safety to the workers. The outstretched support members 705 can be coupled to the trusses and/or the support columns 19 or roof assembly 1 using any suitable fastener at the proximate end 707. Similarly, as shown in FIG. 7, a support tether 711 or tensioning device can be used and coupled to the distal end to provide additional stability to the net stretched between the leading edge of the building and the distal end of the outstretched members supporting the net. The diagonal support members can be comprised of any suitable material, including but not limited to, alloy, steel, rope, cable, or wood. The diagonal support members 705 can be coupled to the end truss stubs 17 at or near the bottom to the proximate end of the support member and to the safety net 701 at the distal end 709 of the diagonal support member 705. The diagonal support member 705 can be configured to fall in an outward direction, which can allow the net 701 to stretch safely under the system's own dead weight to create a wide, flat fall protection net.

In some exemplary embodiments of the safety net system 700, net coupling members 719, such as saddle bracket hooks, can be used as mounting points or clips for the coupling of the net 701 to the trusses. The net coupling members 719 can be positioned in one or more predetermined locations on the trusses 45. The net 701 can be coupled to the brackets using one or more coupling means, including but not limited to a double-sided carabiner that couples the net directly to the bracket, a single-sided carabiner, or a flat plate opposite side, wherein the net clips directly into the bracket and allows for easier bracket removal, or a double-sided winged plate. The double-sided winged plate allows the carabiner to remain attached to the nets and clips into a hole on the bracket wing.

As shown in FIGS. 5-7, the safety net system can further include a tensioning means 711 configured to ensure that the net portions are taut without a large amount of slack to ensure they can appropriately catch falling objects and not allow objects to slip between the truss and edge of each net. Any suitable tensioning means can be used such as a rope, bolt, ratchet strap, or other mechanical tensioning means. In one exemplary embodiment, the mechanical tensioning means 711 can include ratchet straps, cable-pulleys, or winches wrapped around one or more truss heels or clipped to the double-sided loop bolt.

Once the safety net system has been installed, the overhang tails and purlins of the roof assembly 1 can be installed. In some exemplary embodiments, end fills and wind braces 22 can be combined into a single manufactured component, called an end column top and installed as part of the roof assembly 1. The end column top 23 can be installed when we place the column tops on the treated stubs 17. The roof system can then be squared. After the building is squared, the bracing can be installed to the roof assembly 1. The bracing can include but is not limited to x-bracing and v-bracing. Next the barge board or top F&J board can be installed to the roof assembly 1.

The eaves, gutter, soffit, fascia, and roofing can then be installed on the roof assembly 1, followed by rake trim, ridge cap, and other rooftop accessories. After the roofing materials are installed on the roof assembly 1, one or more workers can then conduct an inspection and walk-through to ensure all of the components have been properly assembled and installed on the roof assembly 1. The support assembly 100 materials can then be staged. The support assembly 100 materials can include columns 19, hinges 49, and girts 51. Hinges 49 can first be installed either to the upper end of the columns 19 or to the bottom of the column top members 20. The column 19 can then be attached to the roof assembly 1 via the hinge 49. The columns 19 can all be attached to the roof assembly 1 using any suitable fasteners, such as screws, bolts, nails, or welding. After the columns 19 and hinges 49 have been attached to the roof assembly, the wall framing can then be attached to the columns 19.

The hinged column design shown in FIG. 3B allows for easier and safer construction of the roof assembly more proximate to the ground, as well as attaching of the wall members to the columns without necessitating workers being in a lift or on a ladder to couple the wall assembly to the roof assembly 1. The hinged column system can couple the columns to the truss heel of the roof assembly 1 prior to raising the roof. In some exemplary embodiments, this can optimize the lifting operation by framing walls simultaneously while constructing the roof assembly. In some exemplary embodiments, the roof assembly 1 comprising the column top member being framed into a temporary support such as the stubs 17 or concrete slab as shown in FIG. 3A. The eave framing and flashing can then be completed prior to the roof assembly being lifted.

After workers have finished the roof assembly 1 and support assembly 100, the safety net system 700 can be removed from the roof assembly. The roof assembly 1 now having the support assembly 100 completely assembled and attached can then be lifted using one or more lifting apparatuses 500. The lifting apparatus 500 can be any suitable means and can be used along with a segmented or single piece load distributing apparatus 400 positioned beneath the trusses or bottom plane of the roof assembly 1 to raise the roof assembly in its entirety. The roof assembly can be lifted by one or more lifting apparatuses from a first position to a second position. Similarly, the lifting apparatus can move and control the roof assembly to stop the roof assembly at any point between the first and second positions. One of ordinary skill in the art would understand that the lifting apparatus may lift the roof assembly to varying heights depending upon the application and desired building.

FIG. 3B illustrates a support assembly 100 coupled to the roof assembly prior to being lifted into position and raised by the lifting apparatus 500. One or more support assemblies 100 can be constructed and coupled to the roof assembly. FIG. 3C illustrates the structure after the roof assembly 1 has been lifted and the support assembly 100 has rotated under the roof assembly 1 via the hinges 49 and coupled to the stubs 17 or other foundation type. Once the support assembly 100 has been fastened into place, the hinges 49 can then be removed or permanently secured. Various embodiments and assembly methods can include the above referenced steps in varying orders. As previously mentioned, the roof assembly 1 can be constructed off of the lifting apparatus 500. Building the roof assembly 1 off of the lifting apparatus 500 can allow for different column-to-truss heel connections, can eliminate a splice region, and can allow for changes to eave framing/flashing of the roof assembly.

Figure 4:
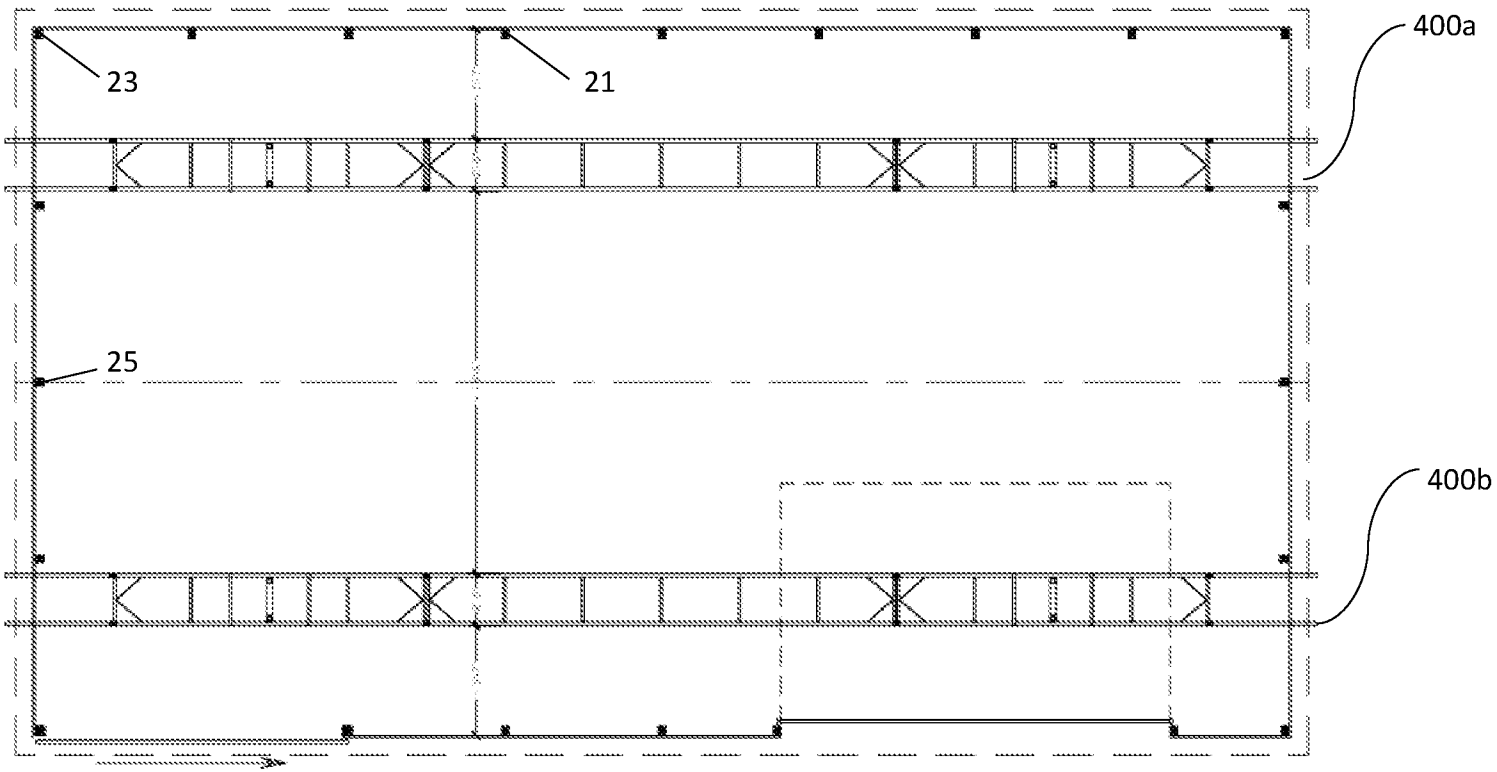
FIG. 4 is an illustration of an exemplary layout of one or more load distributing apparatuses with respect to a building footprint of the present disclosure.
Figure 9A:
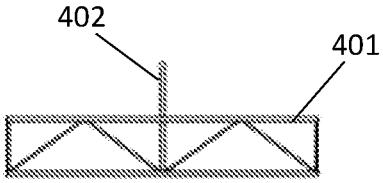
FIG. 9A is an illustration of an exemplary embodiment of a hydraulic segment of a load distributing apparatus frame of the present disclosure.
Figure 9B:
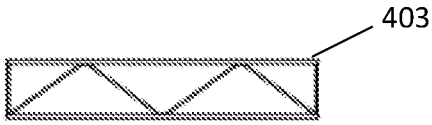
FIG. 9B is an illustration of an exemplary embodiment of a spacer segment of a load distributing apparatus frame of the present disclosure.
Figure 9C:
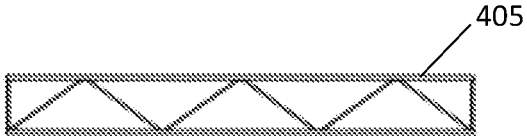
FIG. 9C is an illustration of an exemplary embodiment of spacer segment of a load distributing apparatus frame of the present disclosure.
Figure 9D:
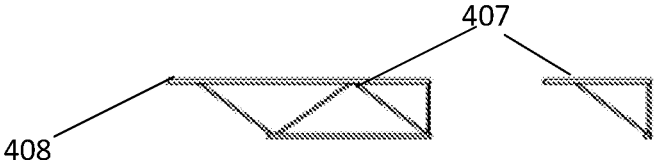
FIG. 9D is an illustration of an exemplary embodiment of a stinger segment of a load distributing apparatus frame of the present disclosure.
Figure 9E:
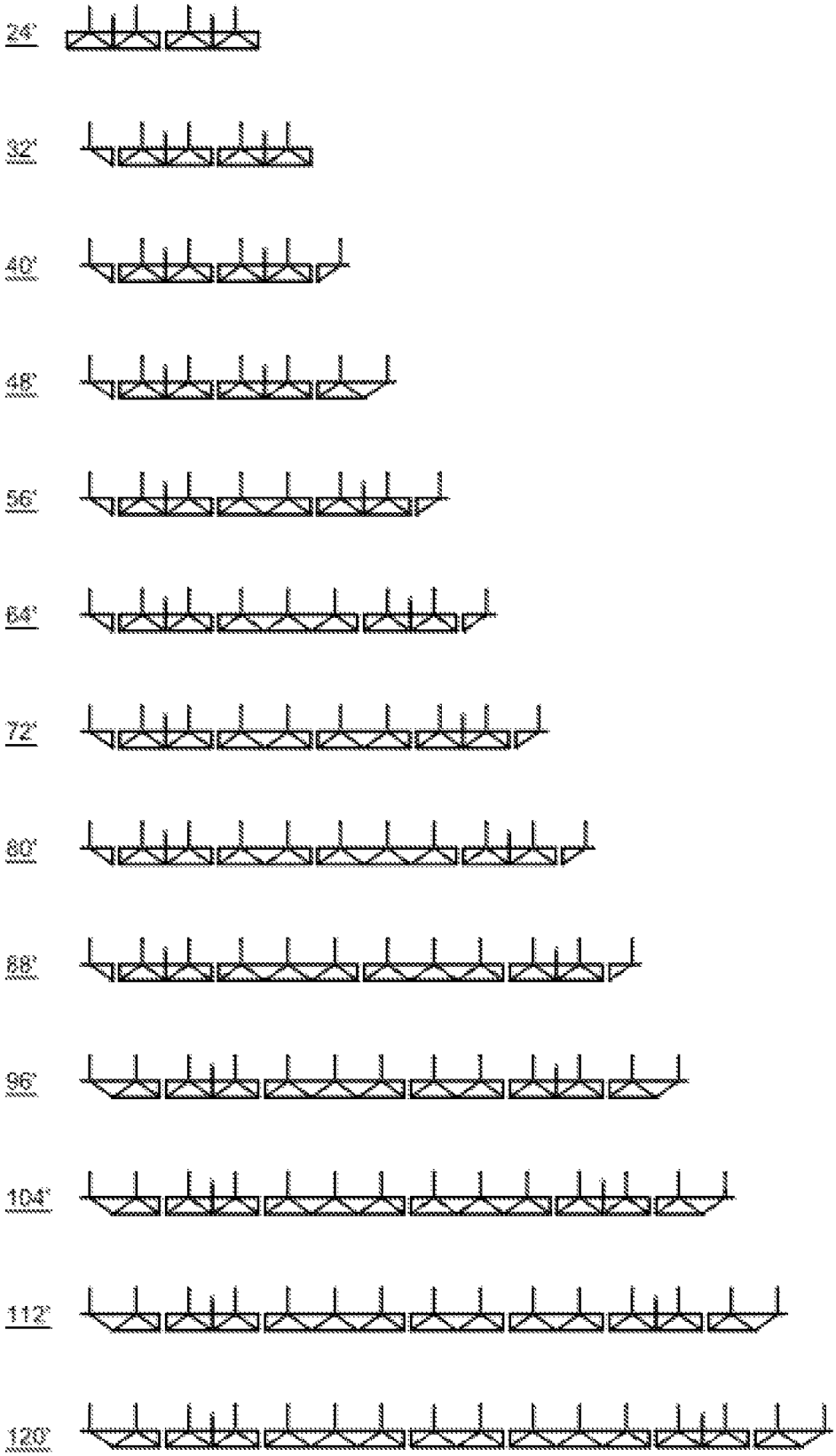
FIG. 9E is an illustration of the various segments shown in FIGS. 9A-D and lengths that can be combined to form an exemplary embodiment of a completed load distributing apparatus.

FIG. 4 provides a plan view or layout of one or more load distributing apparatuses 400 for lifting the roof assembly 1. Depending upon the size of the roof assembly 1, one or more load distributing apparatuses 400*a, b* can be positioned underneath the roof assembly 1. In some exemplary embodiments, the load distributing apparatuses 400 can be positioned between the corner top members 23 and the end column top member 25. Furthermore, as shown in FIGS. 9A-D, the load distributing apparatus 400 can further include various segments and lengths of segments depending upon application and size of the roof assembly to be lifted. FIG. 9A is an exemplary embodiment of a hydraulic segment 401 that can include an extension portion 402 to accommodate a portion of the lifting apparatus 500. FIG. 9B-C show a first spacer segment 403 and a second spacer segment 405 of varying lengths. FIG. 9D illustrates a stinger segment that can have an extension portion 408 extending laterally from one end of the portion to interface with the outer edge of the roof assembly 1. The individual segments can be modular in configuration and can be removably couplable from each other to provide various configurations of the load distributing apparatus 400, depending upon the design, size, and configuration of the desired roof assembly 1.

Figure 8A:
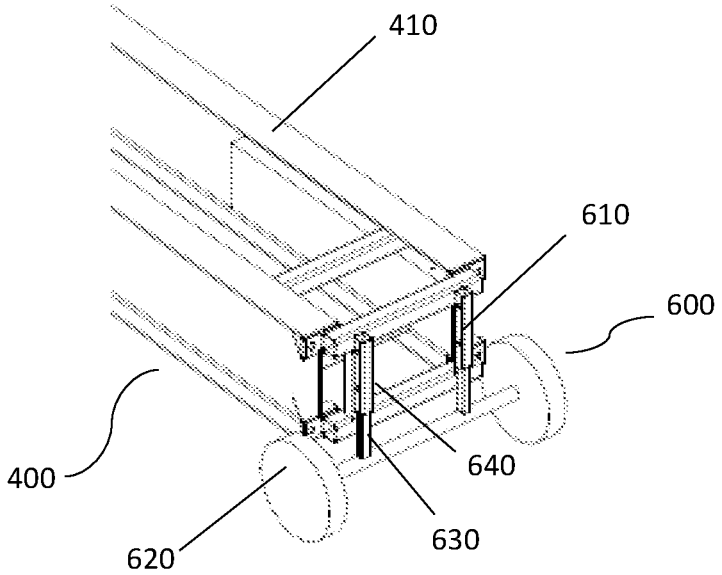
FIG. 8A is an illustration of an exemplary embodiment of a wheel assembly coupled to the load distributing apparatus, wherein the wheels are in an extended position.
Figure 8B:
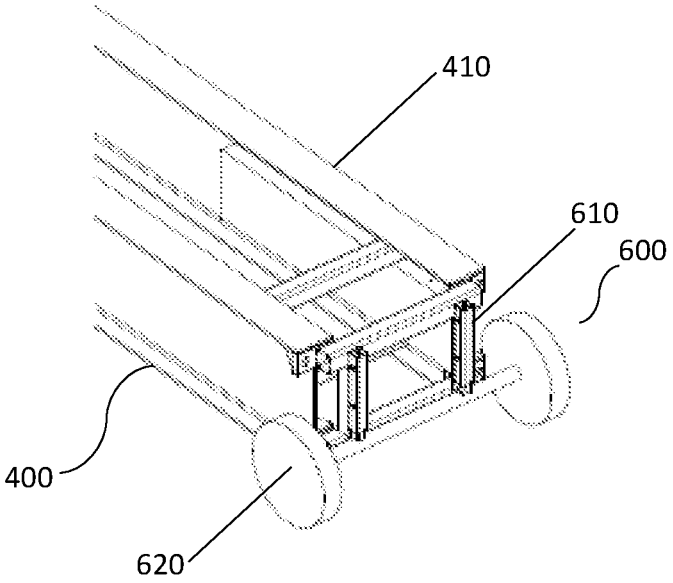
FIG. 8B is an illustration of an exemplary embodiment of a wheel assembly coupled to the load distributing apparatus, wherein the wheels are in a retracted position.
Figure 20A:
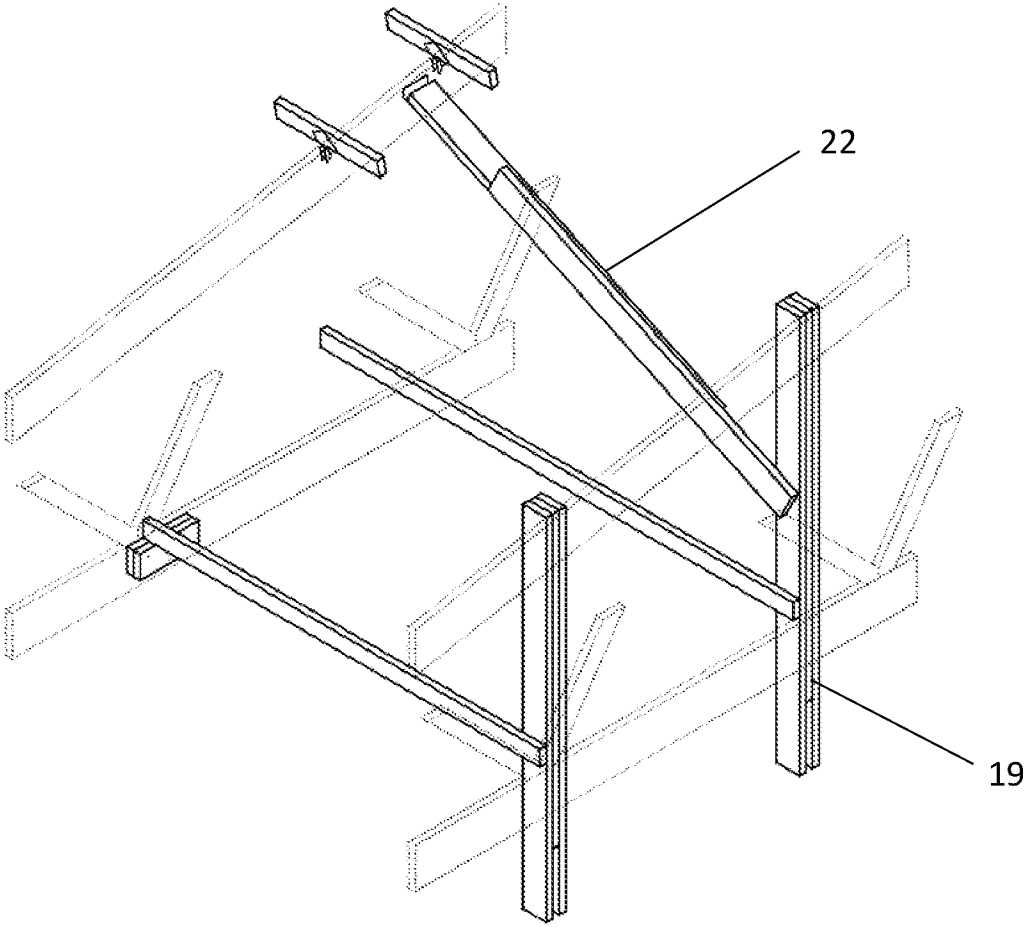
FIG. 20A is a perspective view of a wind brace assembly for an exemplary embodiment of a roof assembly of the present disclosure.
Figure 20B:
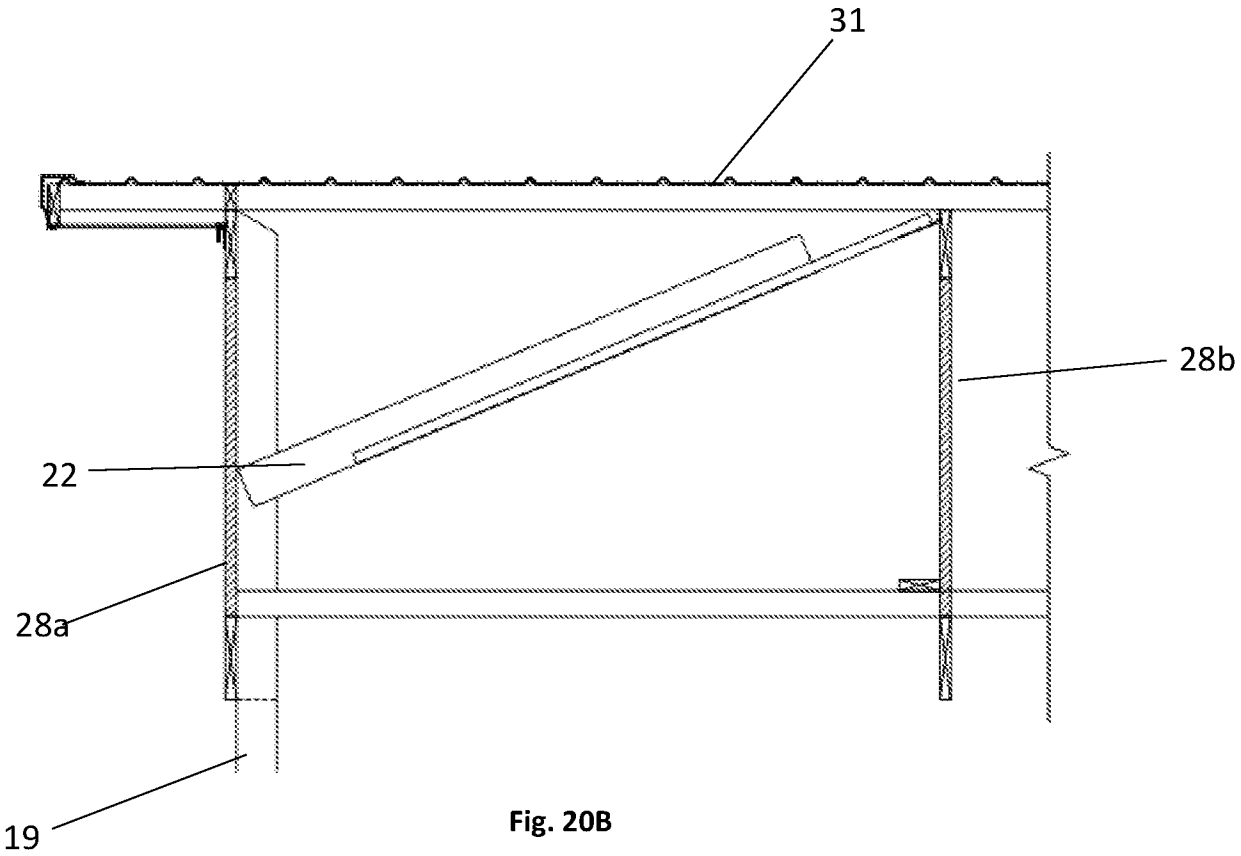
FIG. 20B is a side view of a wind brace assembly for an exemplary embodiment of a roof assembly of the present disclosure.

Additionally, as shown in FIGS. 8A-B, one or more of the individual segments can include a wheel assembly 600 to allow for the load distributing apparatus 400 to be more easily moved into position under the roof assembly 1. The wheel assemblies 600 can be coupled to the bottom or top surface of the load distributing apparatus 400. In some exemplary embodiments, the wheel assemblies 600 can have a moveable portion 610 to allow the wheels 620 to move from an engaged extended position (FIG. 8B) to a stored, retracted position (FIG. 8A). In one exemplary embodiment, the moveable portion 610 can comprise a first member 630 housed within a second member 640. The first member 630 can be extended outside the second member 640 when in the engaged position. The hydraulic segment 401 can include a raised pocket/portion 402 shown in FIG. 7 to house a hydraulic powered cylinder 501 of the lifting apparatus 500. The hydraulic cylinder can be extended out of the hydraulic segment 401. The cylinder can be moved from a fully retracted position to a fully extended position and any intermediate therein. In some embodiments, the stinger segment 407 can include a retractable arm 408 to avoid interference with end wall obstructions and allow the length of the load distributing apparatus of the lifting apparatus to adjust for different lengths and roof assembly configurations. In another embodiment, the stinger segment 407 can be detachable from the load distributing apparatus. This can allow for different size stinger segments to be used, depending upon the necessary requirements of the individual roof structure dimensions and configurations. Furthermore, the spacer segment 403,405 can provide additional extensions to the system for optimal length. The spacer segments 403,405 can vary in length and be added to the hydraulic segment 401 and stinger segments 407. It should be understood that the load distributing apparatus can include one or more of each of the segments. In some embodiments, a spacer segment or stringer segment may not be required. A diagonal member 22 can be incorporated into a preformed column as shown in FIG. 1A or alternatively be added between trusses as shown in FIG. 20A-20B to operate as a wind brace system. In some exemplary embodiments, the structure can further include a wind brace system that can include, but is not limited to, diagonal members 22 at the end wall which can brace columns 19 at the ends and limit the need to have to lift a truss 28 at the end of the truss sections (e.g., 28*a* or 28*b*). This can allow for the trusses to be lifted more centrally on the truss sections. The ability to centrally lift the trusses will allow better clearances and functionality of wall assemblies as they rotate downward as the roof assembly is lifted.

Figure 10A:
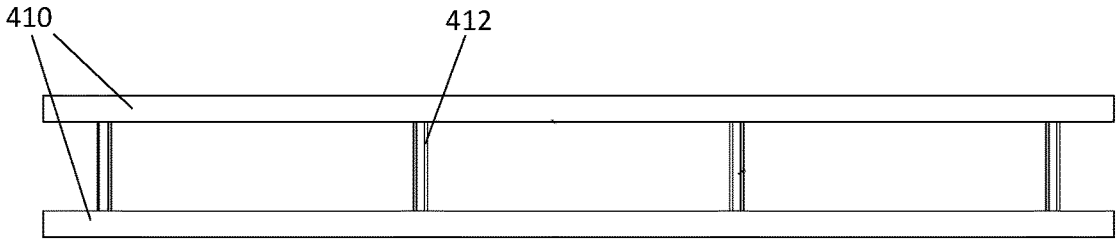
FIG. 10A is a top view of a portion of the load distributing apparatus segment.
Figure 10B:
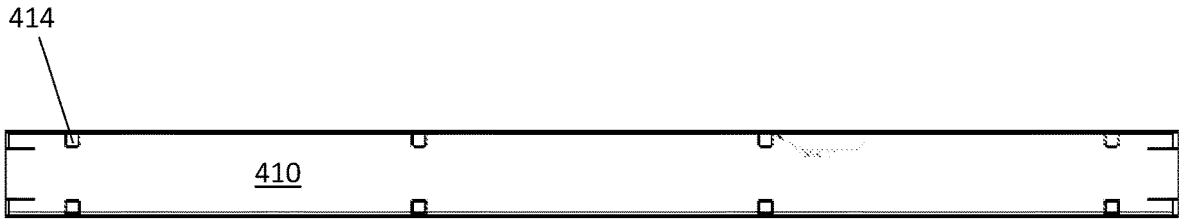
FIG. 10B is a side view of a portion of the load distributing apparatus segment.
Figure 10C:
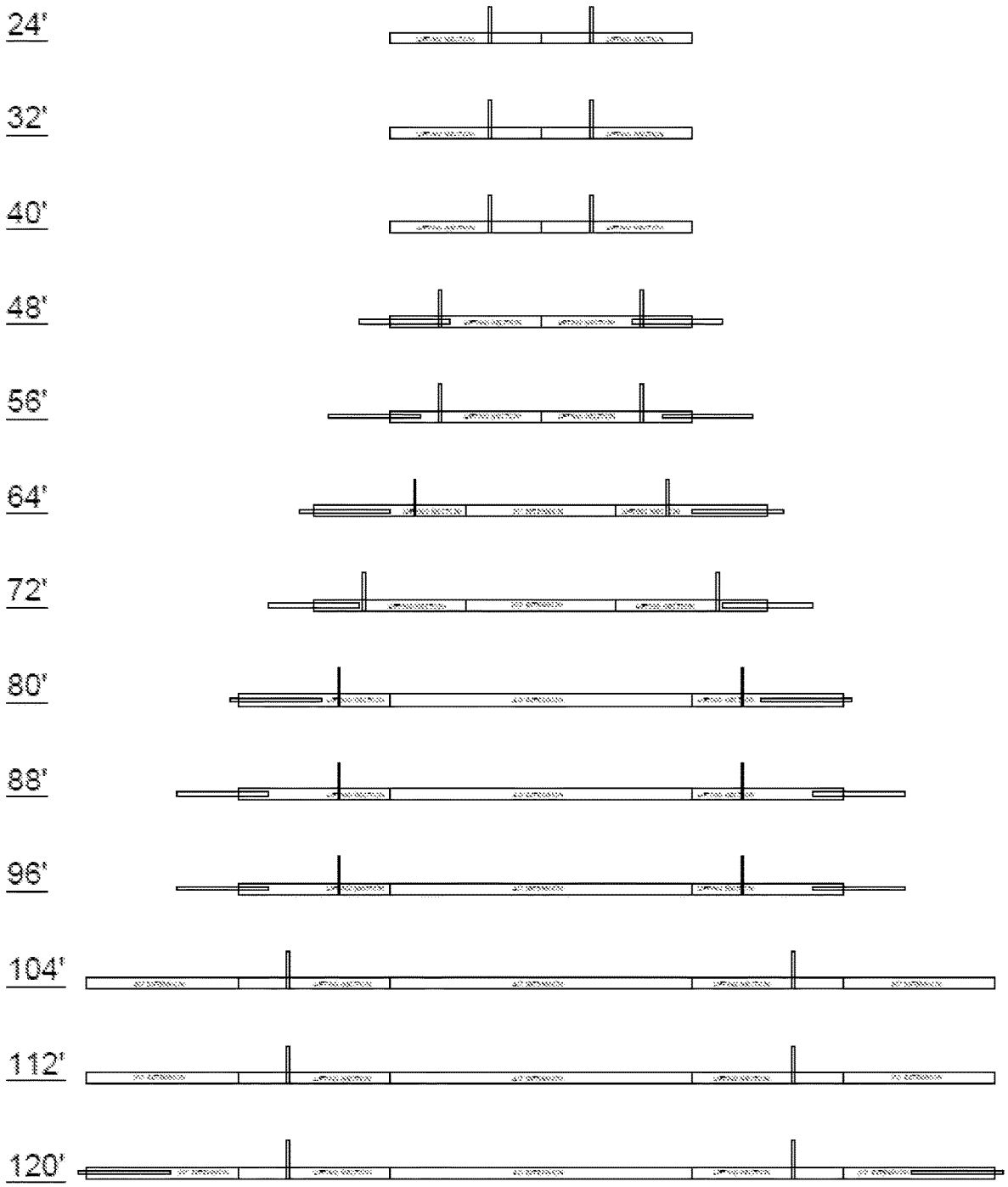
FIG. 10C is an illustration of the various segments shown in FIGS. 10A-B and lengths that can be combined to form an exemplary embodiment of a completed load distributing apparatus.
Figure 14A:
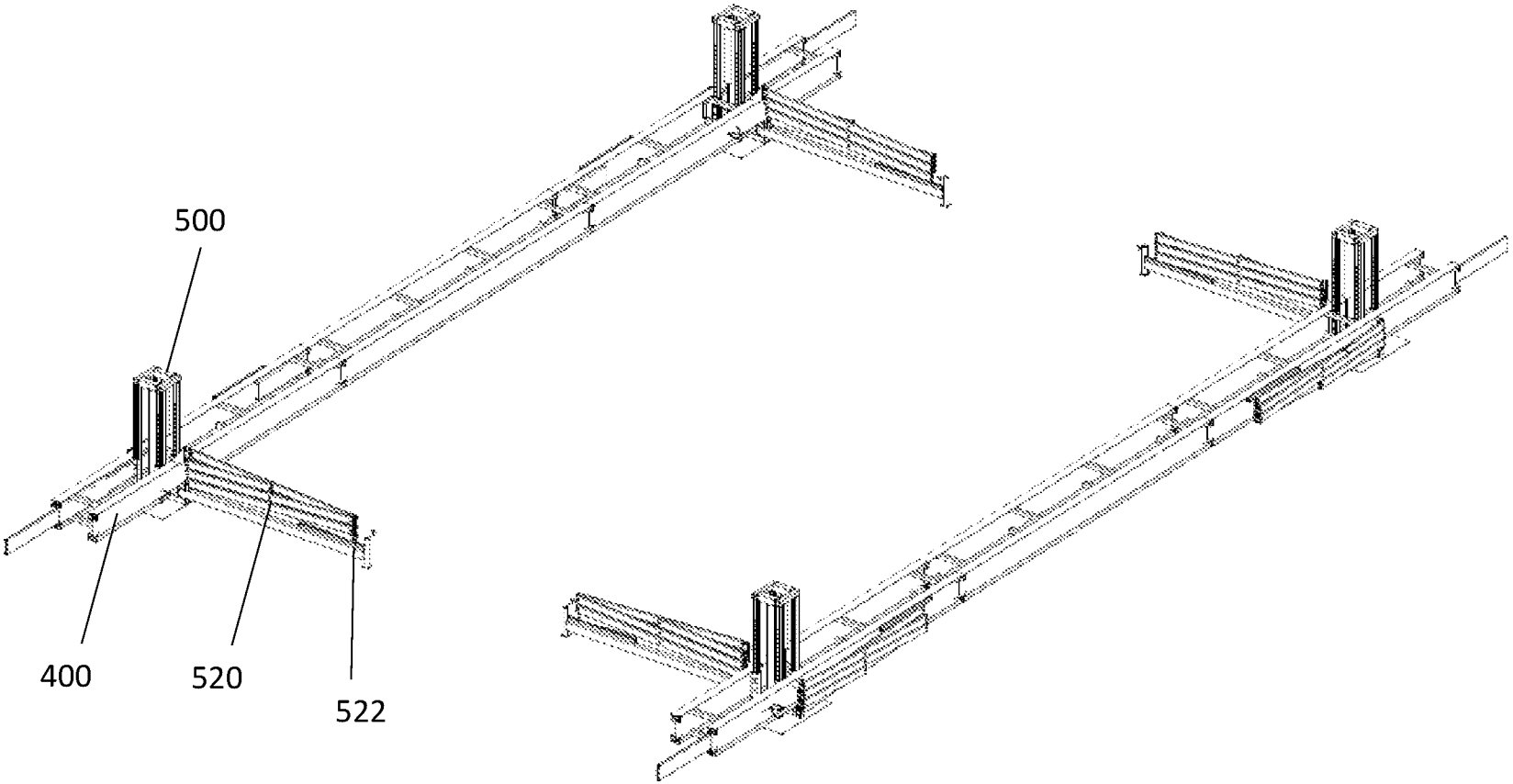
FIG. 14A is an illustration of an exemplary embodiment of a load distributing apparatus and lifting apparatus having scissor braces in a retracted position.
Figure 14B:
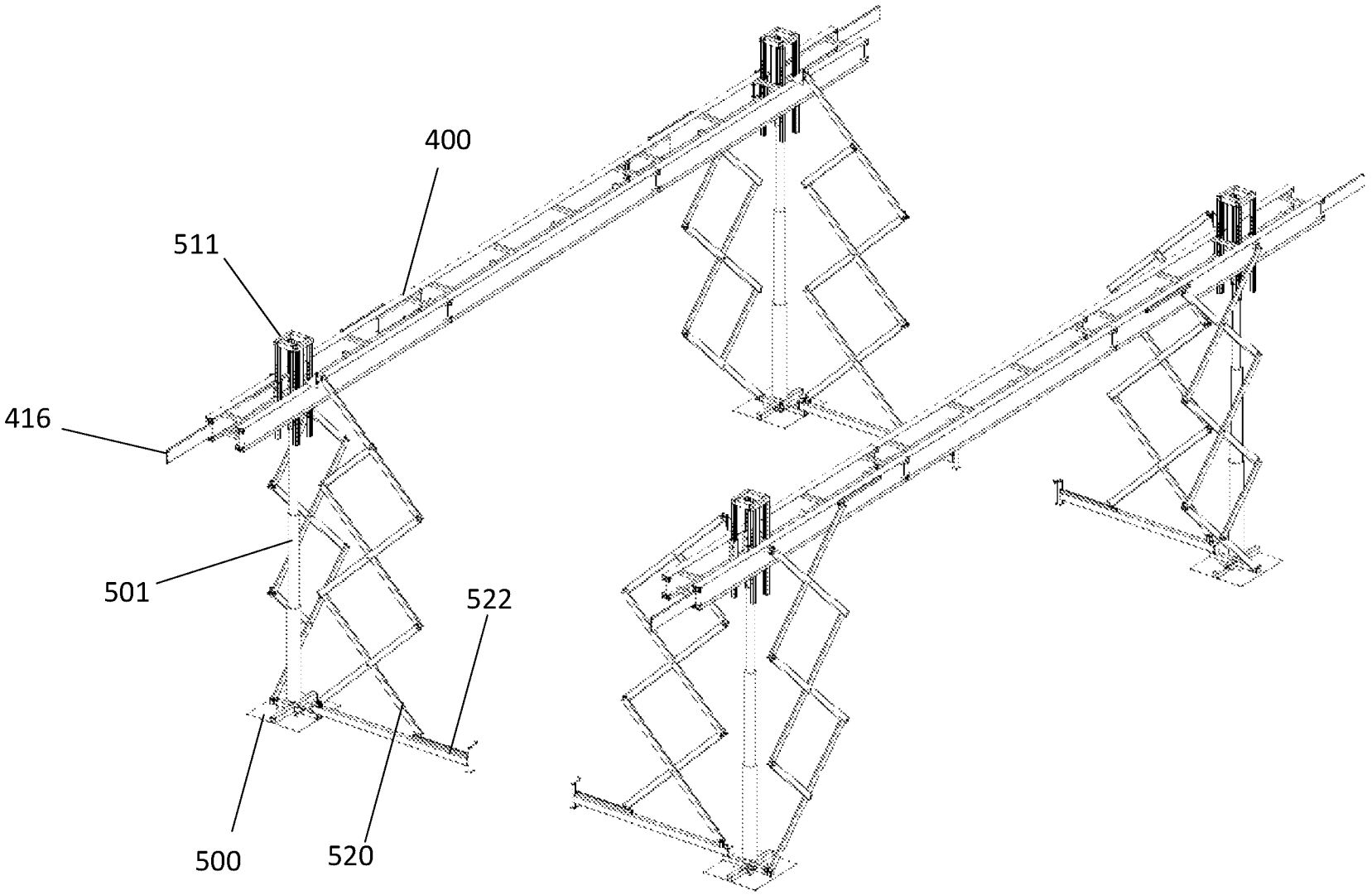
FIG. 14B is an illustration of an exemplary embodiment of a load distributing apparatus and lifting apparatus having scissor braces in an extended/lifted position.
Figure 14C:
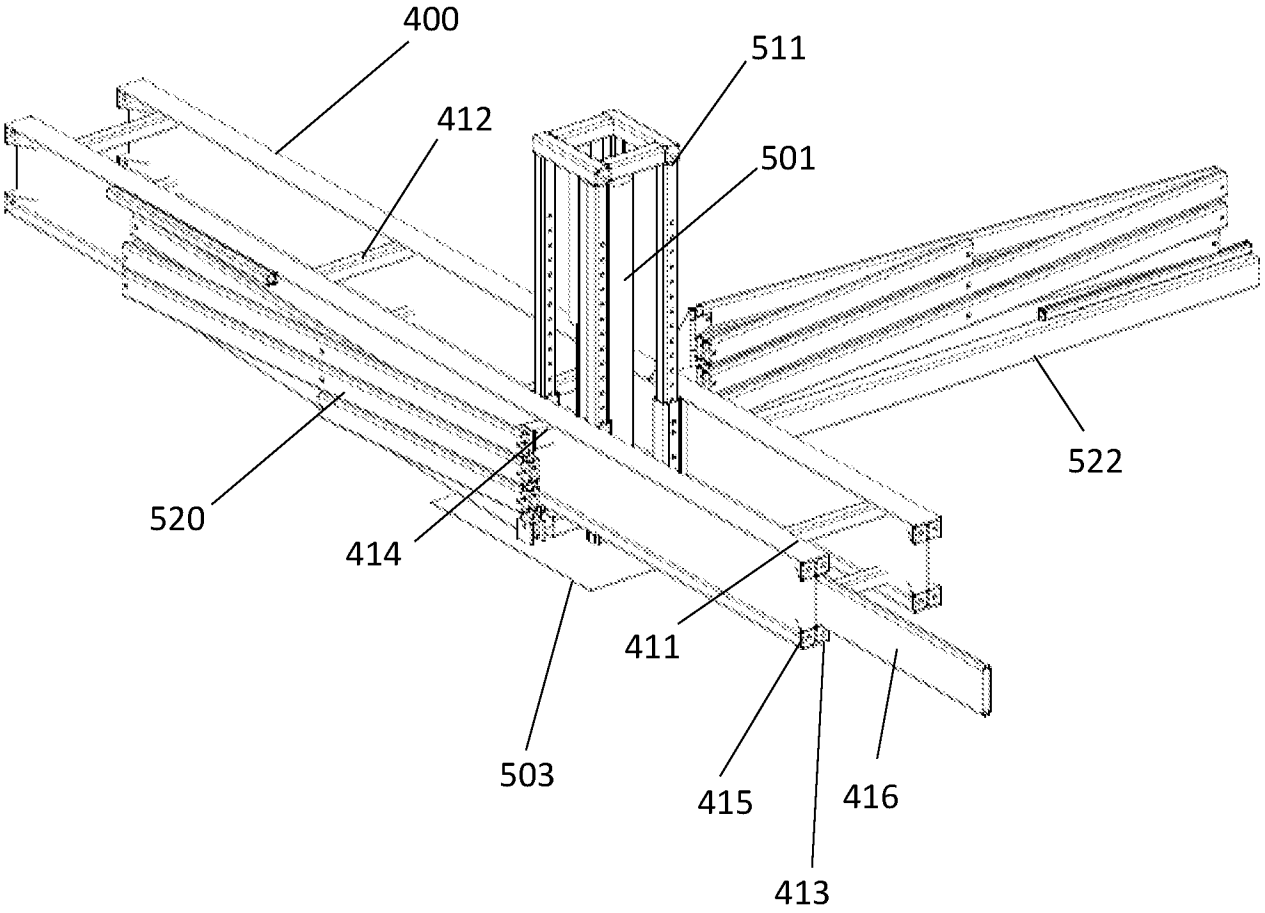
FIG. 14C is a close-up illustration of the load distributing apparatus and lifting apparatus of FIG. 14A.
Figure 14D:
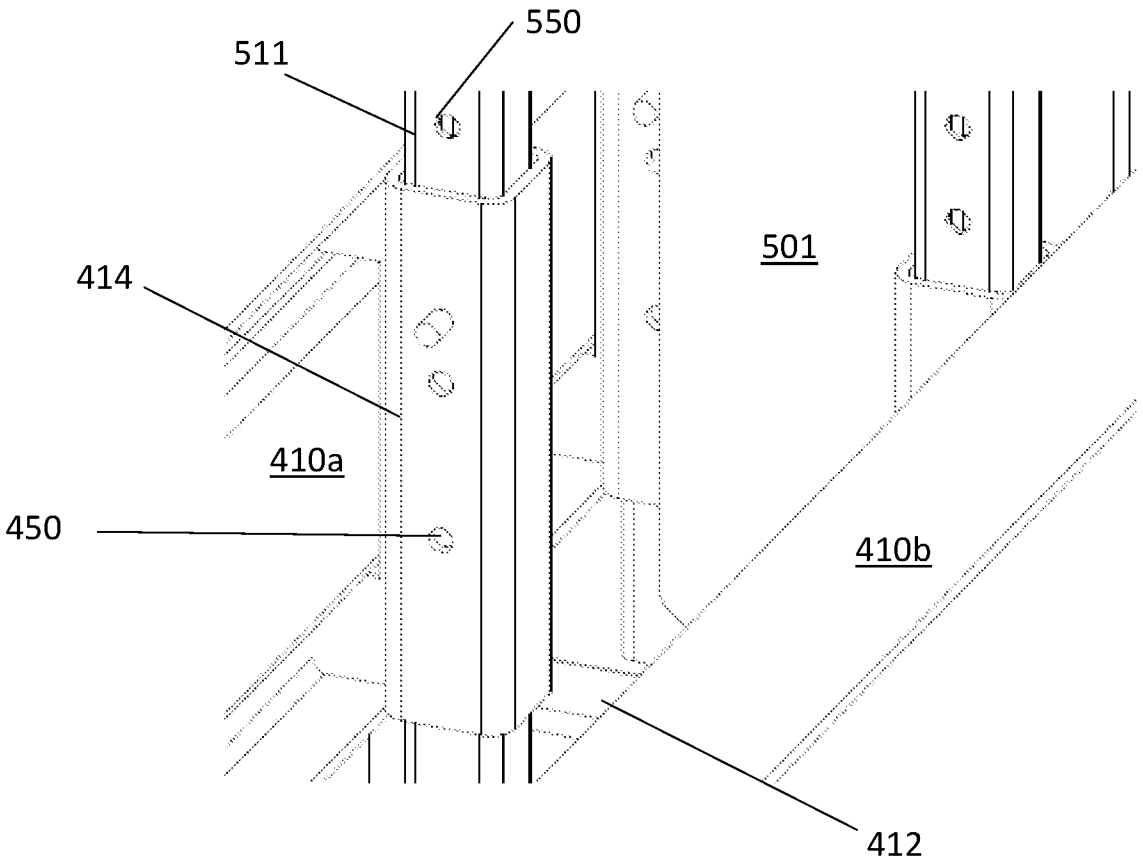
FIG. 14D is a close-up illustration of the load distributing apparatus and lifting apparatus of FIG. 14C.

In some exemplary embodiments, a load distributing apparatus 400 can be a three-dimensional space frame as shown in FIGS. 9A-E. The illustration in FIG. 10A provides for various lengths of load distributing apparatus 400 depending upon the size of the roof assembly. Other exemplary embodiments of the load distributing apparatus 400 are shown in FIGS. 10B-C. In one exemplary embodiment, the load distributing apparatus 400 can include two lateral members 410 that can be coupled together using one or more connecting members 412. In some exemplary embodiments, the lateral members 410 can take the shape of an I-joist and be made from any suitable material. The connecting members can be perpendicularly positioned between the two lateral members 410. In some embodiments, one or both sides of the lateral members 410 and one or more coupling points 414 can be included to provide a coupling point for one or more scissor braces 520 of the lifting apparatus 500. The scissor braces can have a first end and a second end, wherein the first end can be coupled to a portion of a base member 503 of the lifting apparatus 500 and the second end can be coupled to a portion of the load distributing apparatus 400. In one exemplary embodiment, a lateral member and one or more of the coupling points 414 can include, but not is not limited to, a quad receiver. In one exemplary embodiment, the quad receiver coupling point 414 can be used to couple to the frame 511 of the lifting apparatus. The quad receiver 414 and the frame 511 can have corresponding apertures 450, 550 to allow for coupling using any suitable fastener. The coupling points 414 can be located on the first side and second side of the lateral members 410. The coupling points can be used to couple the load distributing apparatus 400 to the lifting apparatus 500 as shown in FIG. 14D. In some exemplary embodiments, the coupling points on the first side of the lateral members 410 can be used to couple to the scissor brace (FIG. 14C), whereas the coupling points on the second side of the lateral members can be used to couple to the lifting apparatus 500 as shown in FIG. 14D. The coupling point 414 can be any suitable configuration and coupled to the lifting apparatus using any suitable means, such as a fastener. As shown in FIGS. 14A-C, some exemplary embodiments can include two scissor braces per individual lifting apparatus. The scissor braces 520 can be found on the corners of the lifting apparatus and roof assembly, respectively, to further aid in limiting lateral movement as the roof assembly is raised into position.

Figure 11A:
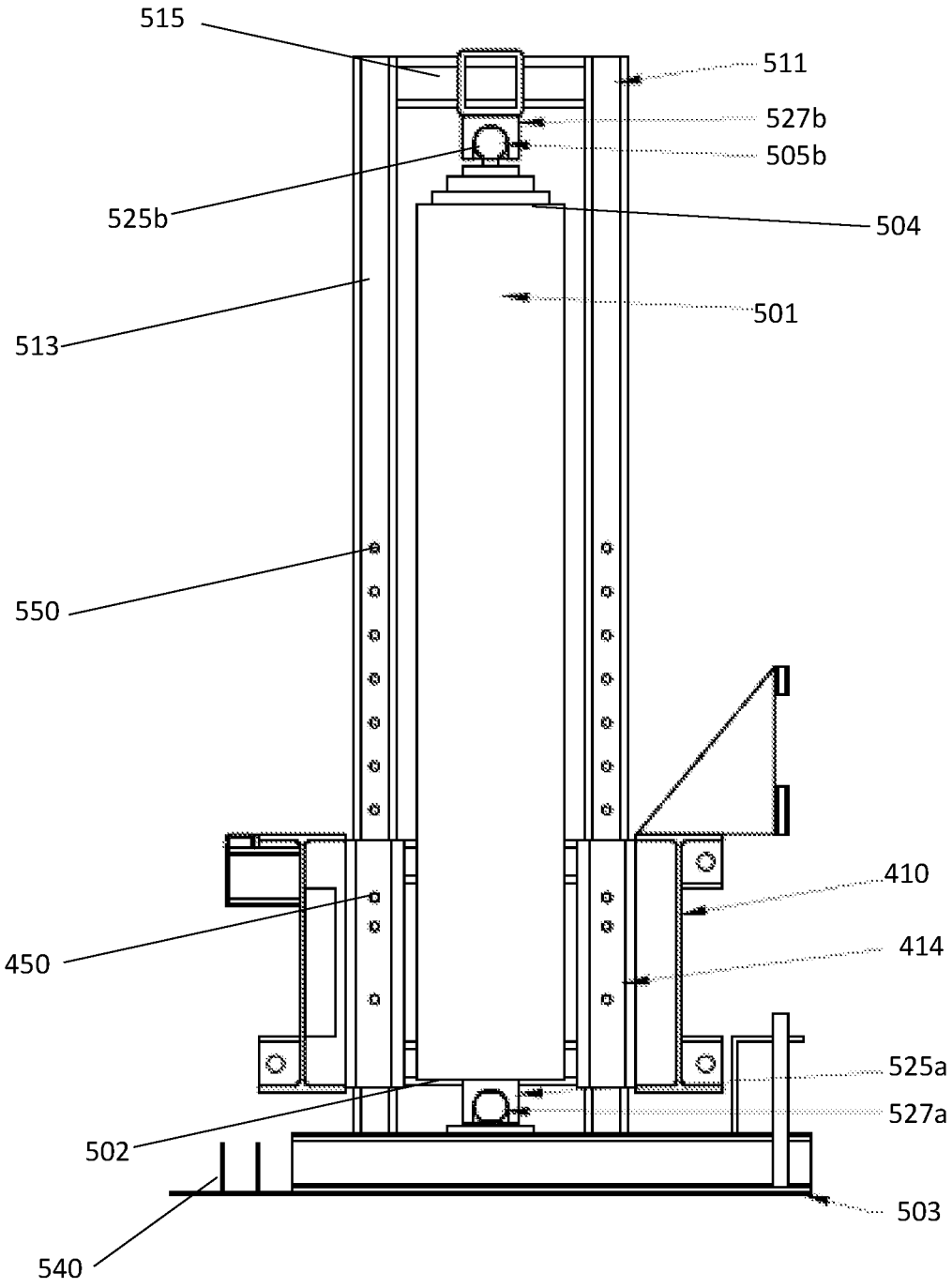
FIG. 11A is an illustration of an exemplary embodiment of a lifting apparatus of the present disclosure.

One or more lifting apparatuses 500 can be assembled for use to lift the completed roof assembly 1. A lifting apparatus 500 can initially be positioned under the cross members of the roof assembly prior to construction of the roof assembly 1 or under a portion of a load distributing apparatus 400. In one exemplary embodiment, the lifting apparatus 500 can include a hydraulic lift cylinder assembly 501 as shown in FIG. 11A. In other exemplary embodiments, the lifting apparatus could comprise a lifting apparatus that could raise the roof assembly 1 by pulling the roof assembly from above, such as a boom crane or other overhead lifting means. In some exemplary embodiments, the load distributing apparatus can extend past the end of the roof assembly to allow for easy cabling and support coupling points to allow a crane or other lifting mechanism to raise the roof assembly.

In other embodiments, the proximate end 502 of the hydraulic cylinder 501 can be coupled to a base portion or foot 503 of the lifting apparatus 500. The base portion 503 can be configured to distribute the load of the structure over a larger area of the ground. The base 503 can have a first side 506 and a second side 508. The base 503 can either be integrated into the hydraulic cylinder or consist of cribbing. Additionally, in some exemplary embodiments, the base 503 can include one or more wheel assemblies configured to easily move the lifting apparatus into place at a site location. The wheel assemblies can be retractable and moved in and out of position to allow for the base 503 to be flat upon the ground surface when the hydraulic cylinder is in use and can be deployed when not in use to aid in moving the lifting apparatus 500 into position, or in removing the lifting apparatus 500.

Figure 11B:
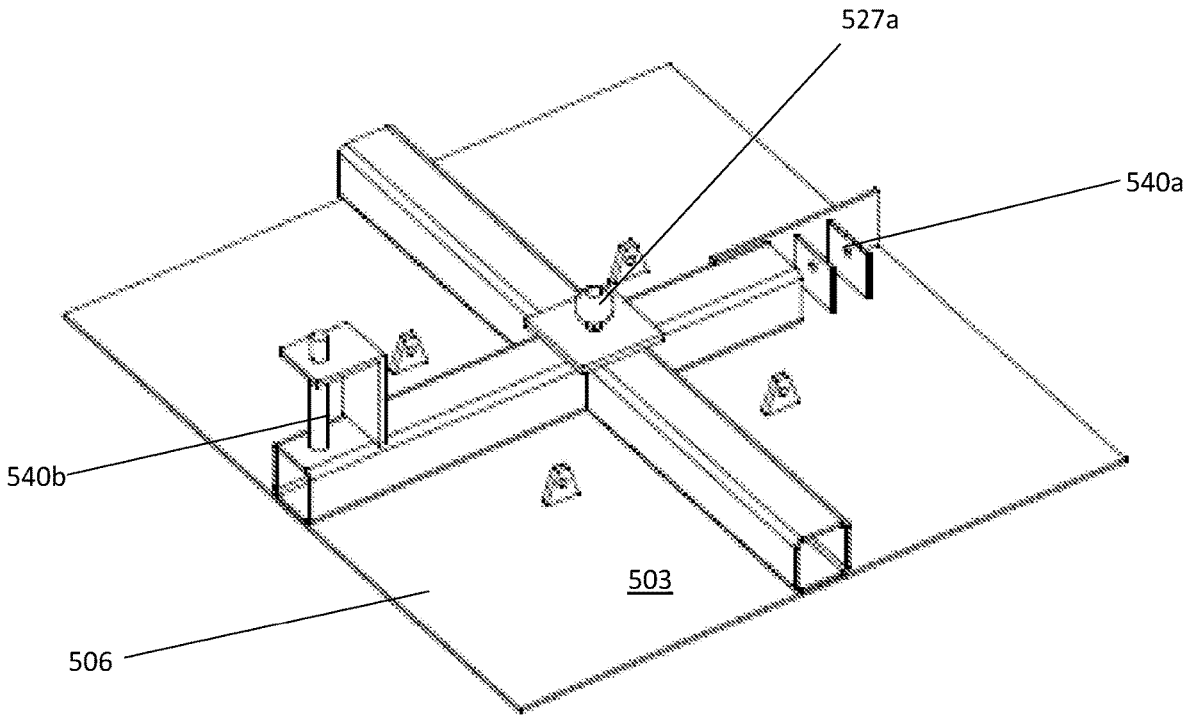
FIG. 11B is an illustration of an exemplary embodiment of a base portion of the lifting apparatus of the present disclosure.
Figure 12A:
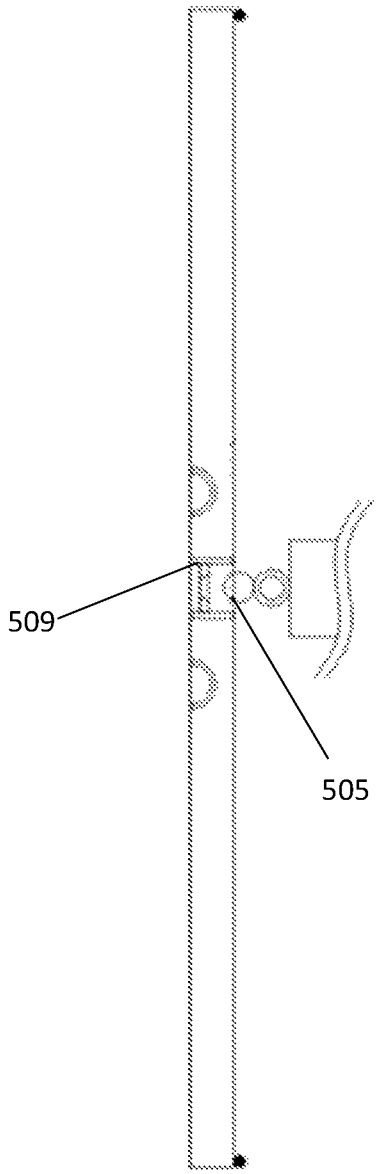
FIG. 12A is a side view of another exemplary embodiment of a base portion of a lifting apparatus of the present disclosure.
Figure 12B:
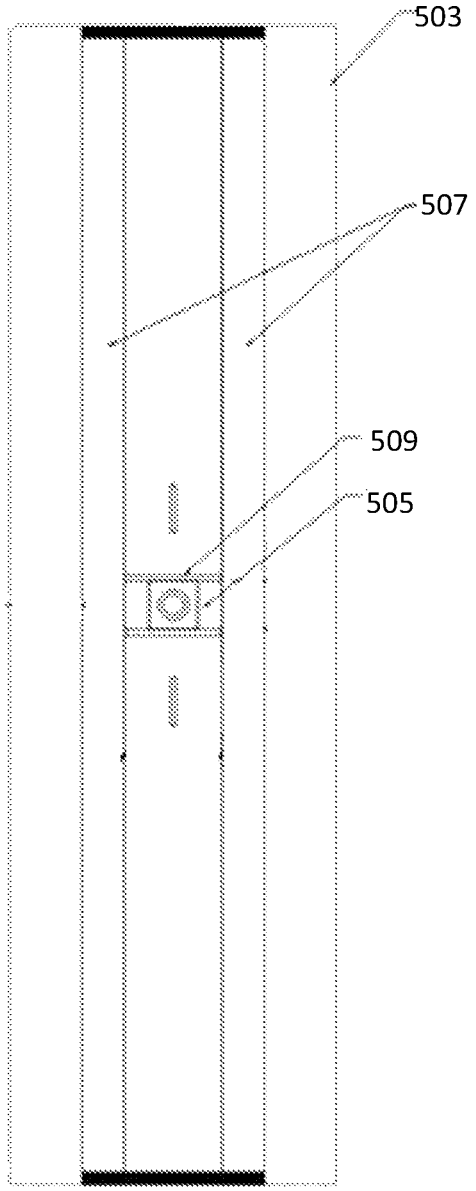
FIG. 12B is a top view of another exemplary embodiment of a base portion of a lifting apparatus of the present disclosure.

The cylinder 501 can be coupled to the base, and in some embodiments include a pivotable connection means 505, including but not limited to, a swivel-end ball mount at the base 503 and at the connection to the lifting apparatus, to allow for the building to rise evenly without binding or damaging the cylinders 501, as shown in FIGS. 11-12. The pivotable connection means 505 can be further supported to the base 503 using one or more bracing members 507 and brackets 509. The lifting apparatus can further include a support means or frame 511 that can interface with the load distributing apparatus 400. The frame can have a vertical support portion 513 and a lateral top portion 515, coupled to the distal end 504 of the hydraulic cylinder 501. In some exemplary embodiments, the distal end of the hydraulic cylinder 501 is coupled to the frame 511 using a pivotable connection means 505. The pivotable connection means can include a ball portion 525 and a receiver portion 527. The frame 511 can be used to interface with a portion of the load distributing apparatus 400 and in some exemplary embodiments can be coupled to a portion of the load distributing apparatus 400.

As shown in FIG. 11B, in one exemplary embodiment, the base portion 503 can include the ball portion 527 and one or more scissor brace mounting points 540. In one embodiment, a first scissor brace mounting point 540*a* can couple directly to the scissor brace 520 and a second scissor brace mounting point 540*b* can couple to a lateral extension portion 522 for the scissor brace 520. The scissor braces 520 can then be coupled to the respective mounting points of the load distributing apparatus 400 and the lifting apparatus 500.

To aid in bracing the roof assembly 1 during the lifting, a scissor brace 520 can be positioned in one or more locations of the roof assembly 1 and the lifting apparatus 500. In one embodiment shown in FIG. 14B, one or more scissor braces 520 can be used on one or more sides of the roofing assembly 1 to stabilize the roof assembly 1 through the entire lifting operation. FIGS. 14A-C illustrate one or more scissor braces 520 that can be coupled to the base portion 503 of the lifting apparatus 500 and to a portion of the load distributing apparatus 400 to control, stabilize, and brace against lateral movement as the roof assembly 1 is lifted into position. Additionally, a scissor brace 520 can allow for the vertical movement of the roof assembly along an idealized y-axis while preventing lateral translation due to settling cylinders 501 and weather environments. The scissor brace 520 can have a lateral extension portion 522 proximate to the base portion 503. The lateral extension portion 522 can be extended out to provide additional support and bracing during the lifting operation of the roof assembly 1.

Figure 15A:
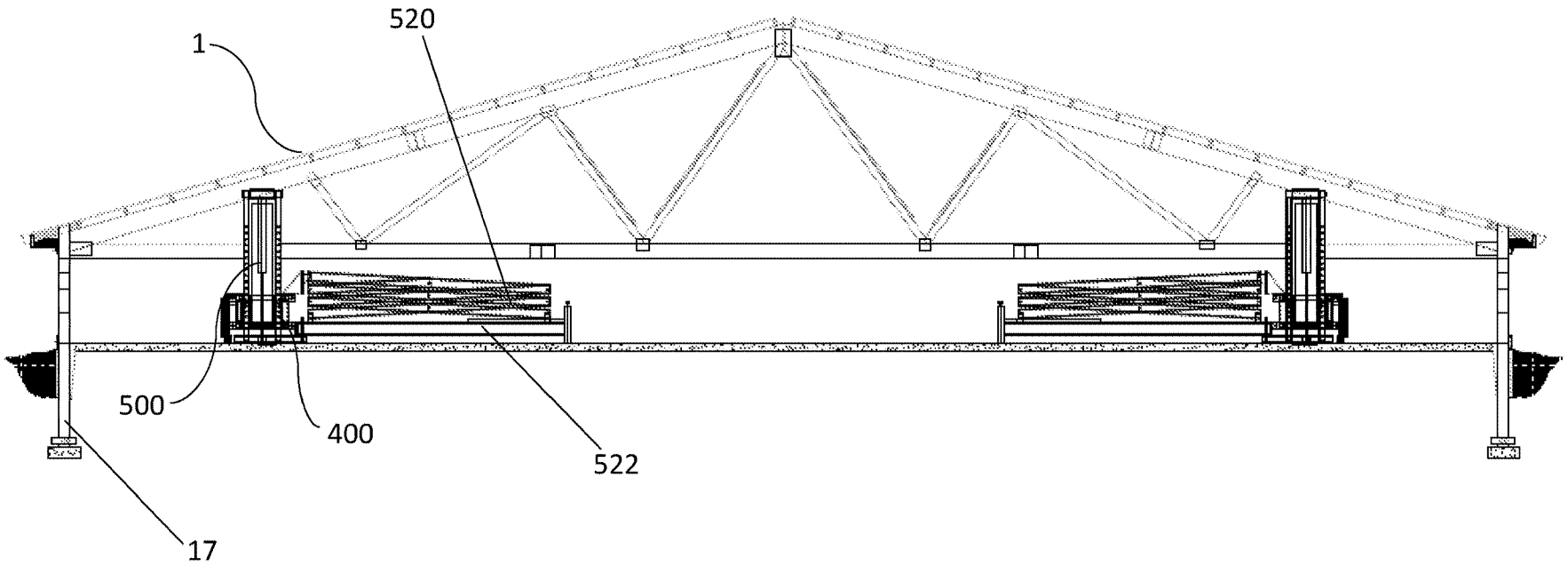
FIG. 15A is an elevation view of an exemplary embodiment of the roof assembly system in the lowered position prior to being lifted.
Figure 15B:
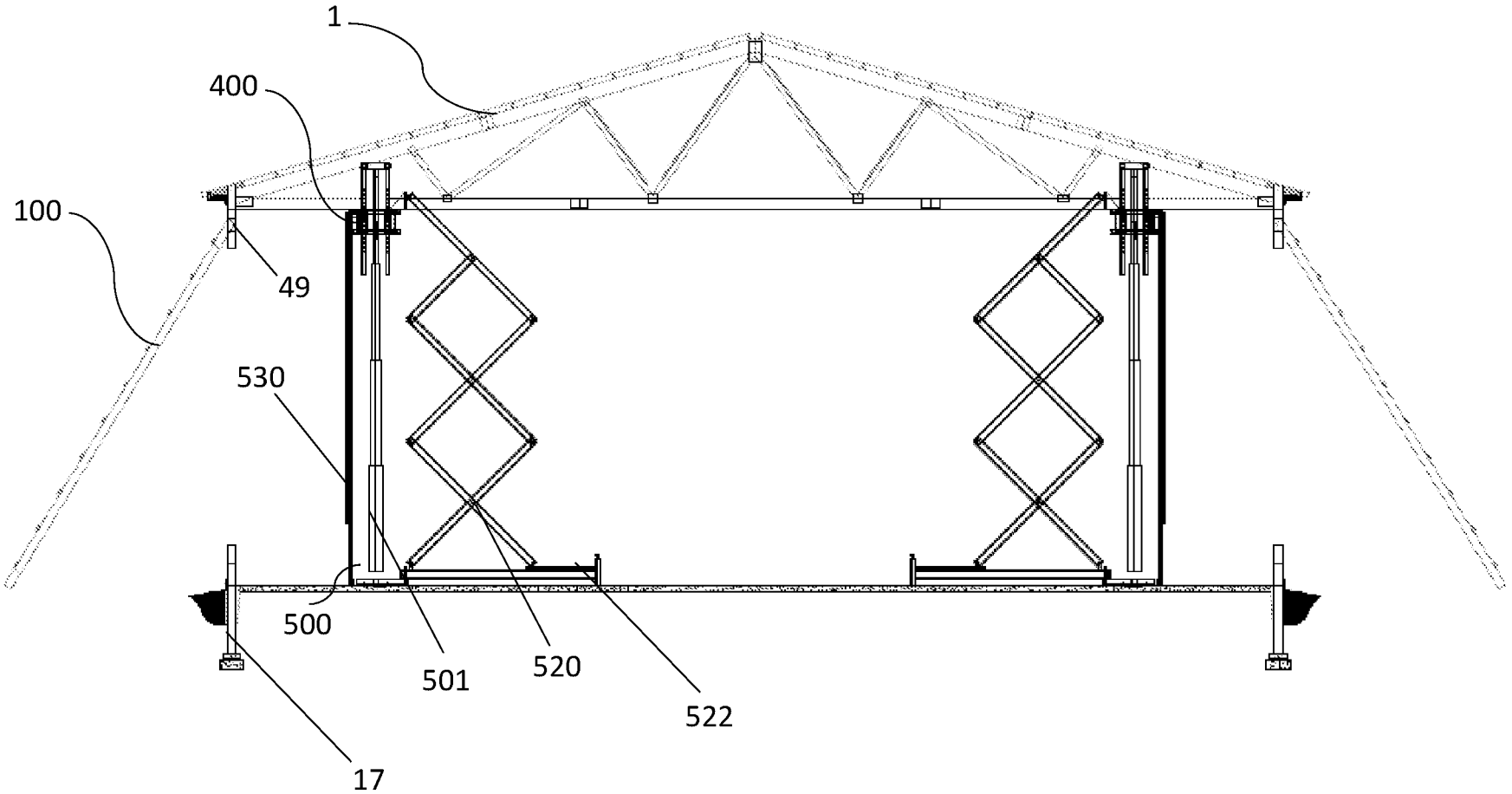
FIG. 15B is an image of the roof assembly lifted using the hydraulic cylinders and truss system in an intermediate lifted position.
Figure 15C:
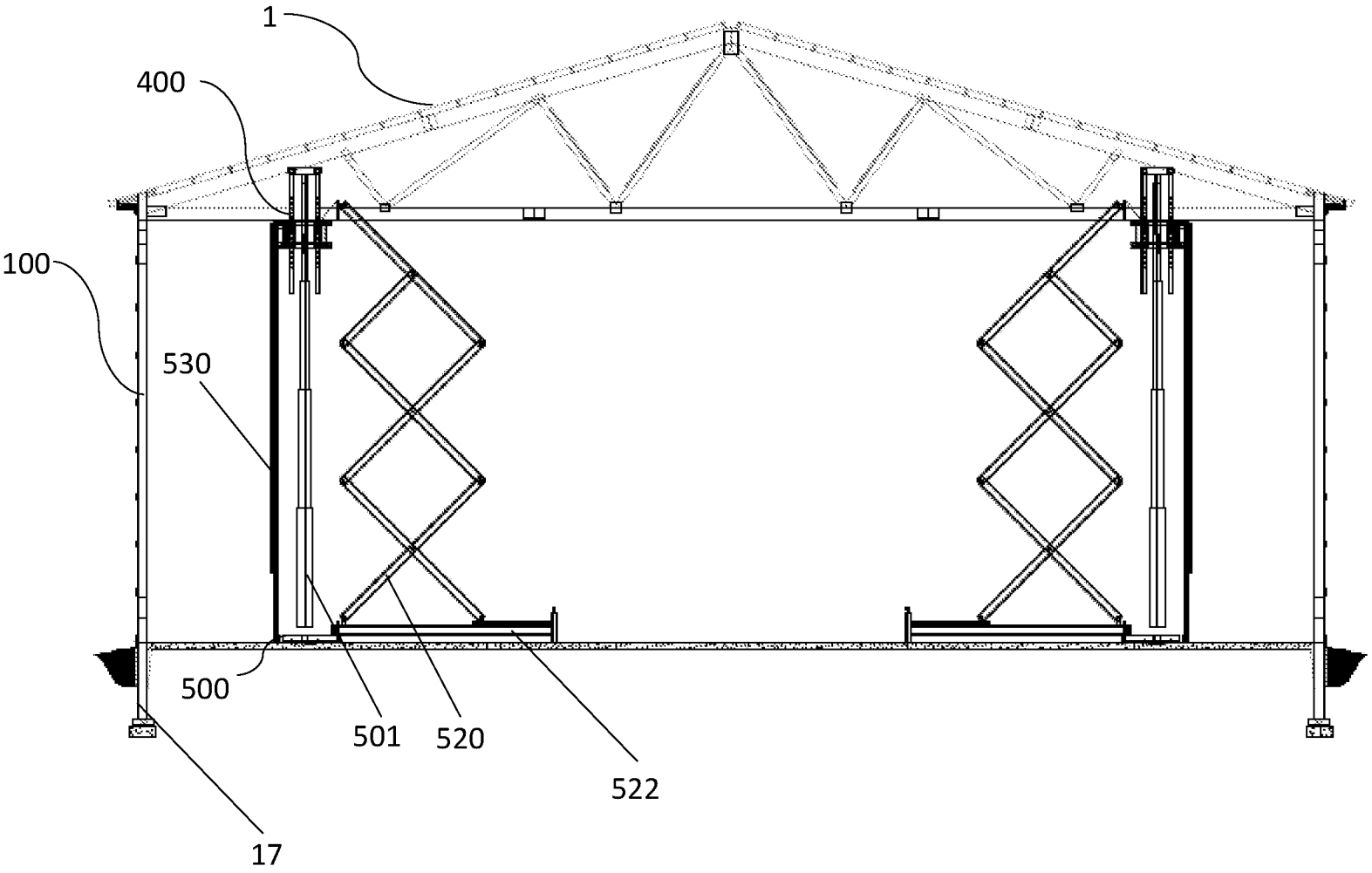
FIG. 15C is an image of the roof assembly fully lifted with the post connected to the base support posts.
Figure 16:
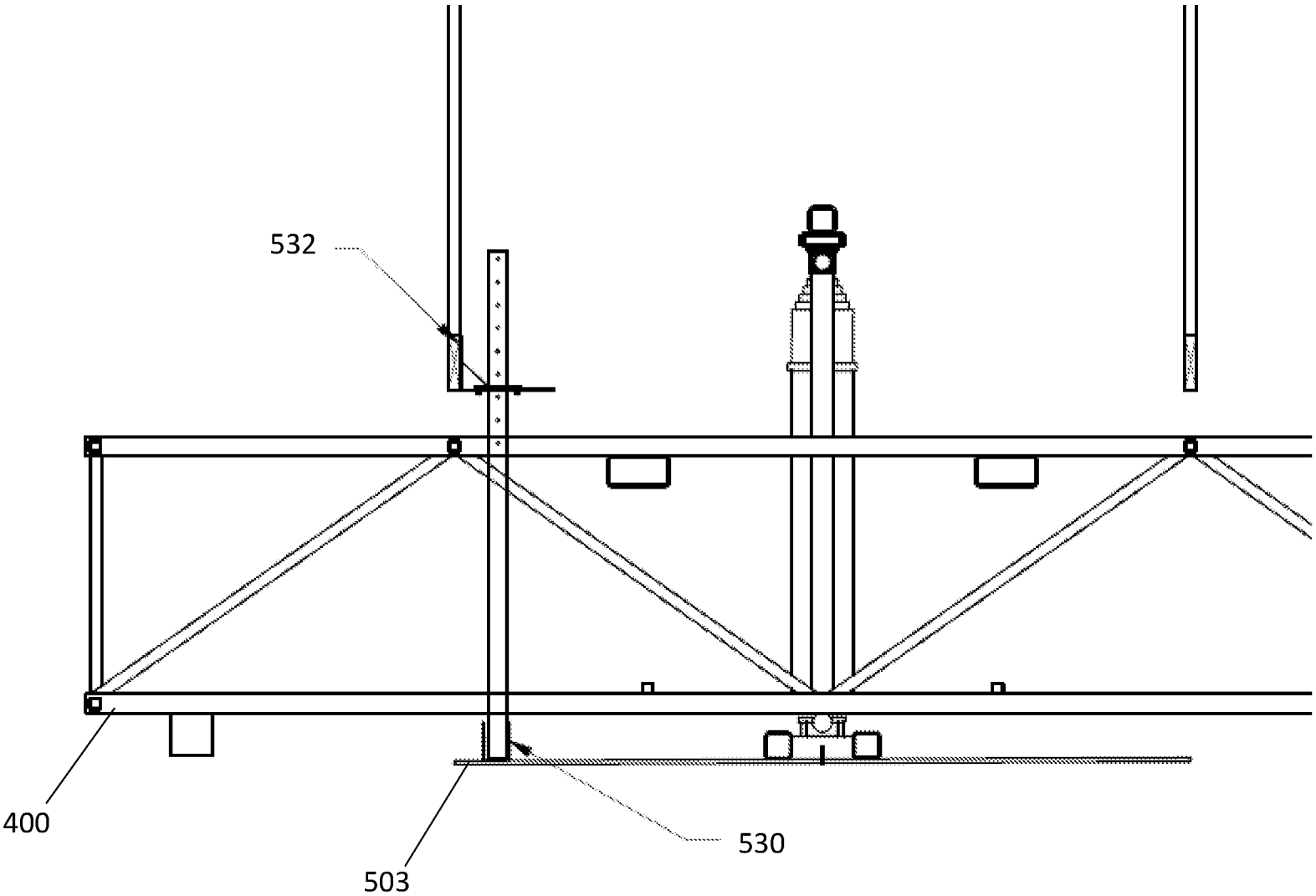
FIG. 16 is an illustration of an exemplary embodiment of a lifting apparatus and descending means having guiding means such as a guide pole.

The lifting apparatus 500 can further include a frame descender 530 that can allow for the lifting apparatus 500 to safely lower and/or guide the load distributing apparatus 400 after the support assembly 100 is positioned under the roof assembly 1. As shown in FIG. 16, one exemplary embodiment, the frame descender 530 can include a pole wherein the first end of the pole is coupled to the base 503 and the second end can be coupled to a chord or portion of an end truss as shown in FIG. 15C. In another exemplary embodiment, the frame descender can be comprised of one or more guide poles having a first end and a second end. The first end of the guide poles can be coupled or fastened to the base 503 of the lifting apparatus 500. The second end of the guide poles can be secured to a portion of the roof assembly, using any suitable means, such as a bracket 532 and fasteners shown in FIG. 16. The frame descender allows for the load distributing apparatus of the lifting apparatuses to be safely lowered back down to the fully retracted position. In another exemplary embodiment, chords or chains can be used as frame descenders 530.

Similarly, the frame descenders 530 can be used to raise the load distributing apparatus 400 from the ground position into contact with the roof assembly. The frame descenders 530 can be retractable or modular in nature to allow differences in building heights and designs. In one exemplary embodiment, the guide poles can be threadedly connected using threading fittings at either end of the pole to allow for additional length to be added or removed based upon the desired application.

The hydraulic cylinder can use a central or master pump 209 that can be powered by a motor, such as an electric, fuel powered generator, and/or a hydraulic fluid powered motor that can power the pump. The lifting apparatus 500 can further include amplifiers that can be configured to adjust signals to proportional valves 513 of the one or more pumps to modify and control the flow of oil to the hydraulic cylinders. The pump 209 can be mounted to a moveable cart or on a vehicle to allow for easy transportation throughout a worksite. The pump 509 can have one or more hydraulic outlets.

Figure 13A:
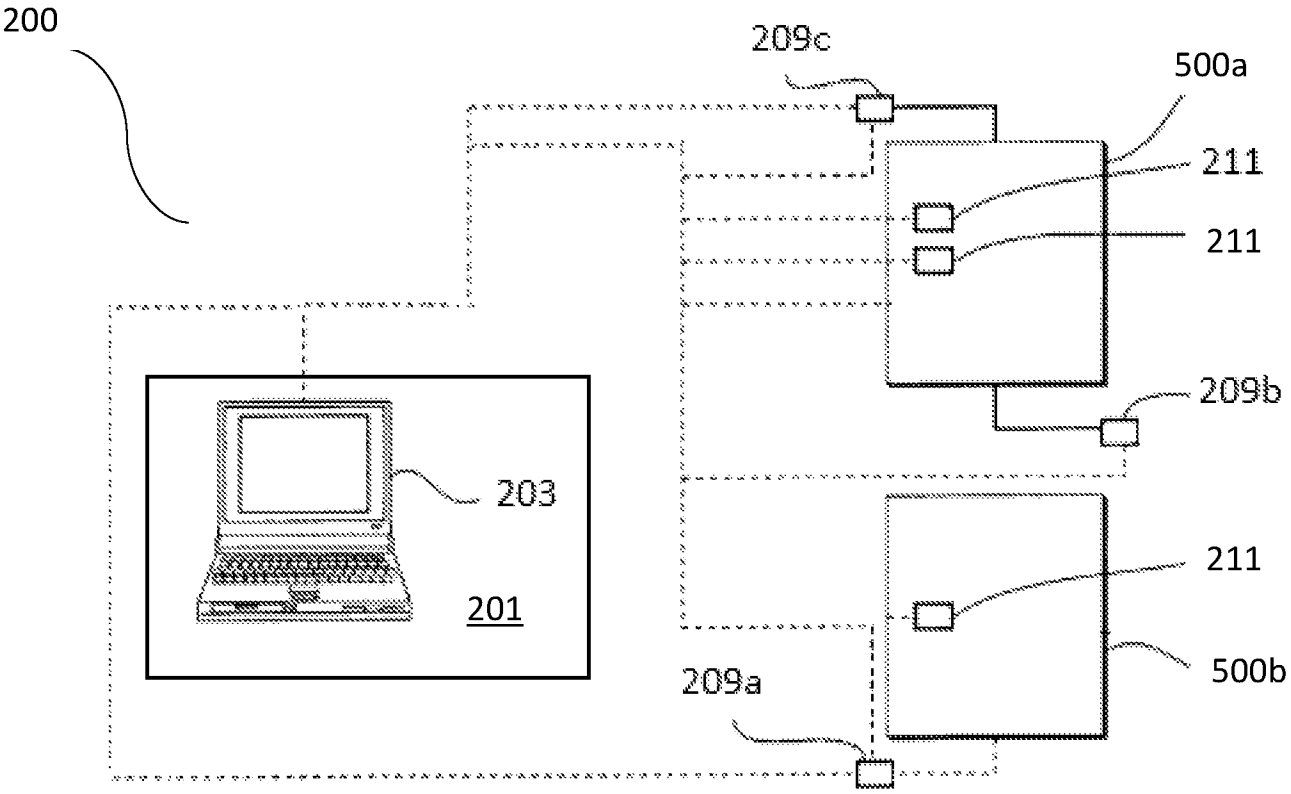
FIG. 13A is a diagram of an exemplary embodiment of a control system for the hydraulic raising system of the present disclosure.
Figure 13B:
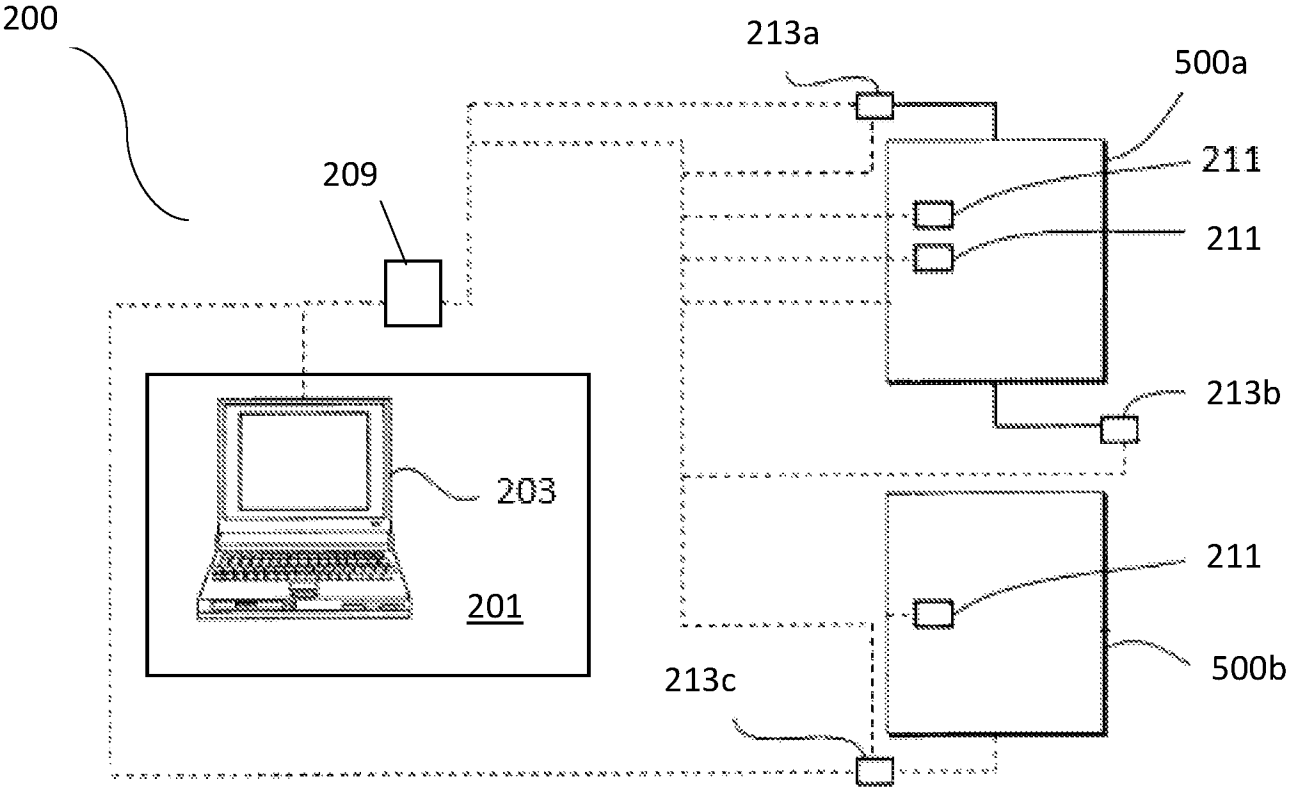
FIG. 13B is a diagram of an exemplary embodiment of a control system for the hydraulic raising system of the present disclosure.
Figure 13C:
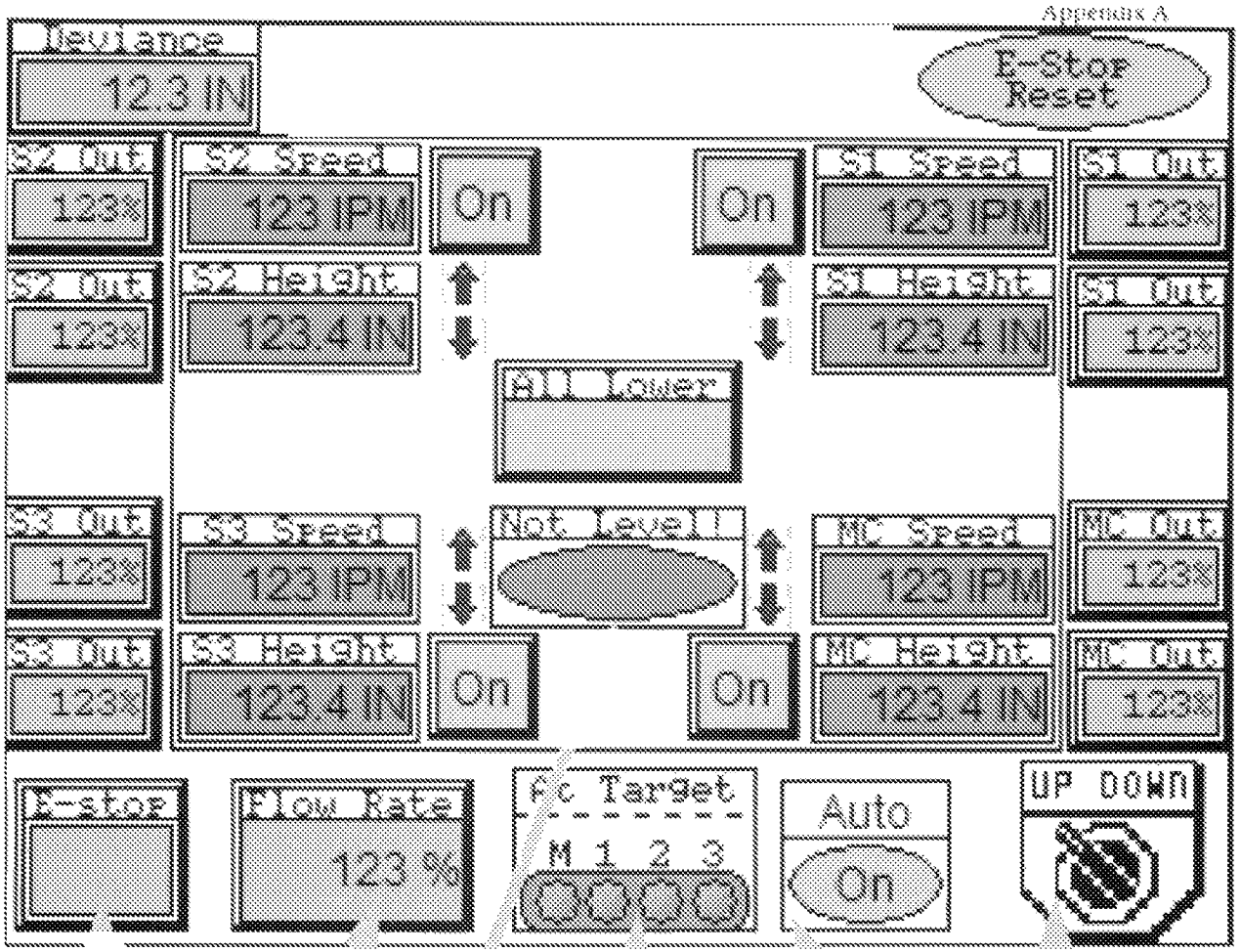
FIG. 13C is an illustration of a user interface of the control system of the present disclosure.

The lifting apparatus 500 can further include a control system 200 or controller 201 that can have a graphical user interface or display 203 as illustrated in FIG. 13, which can be communicatively coupled to one or more pumps 209, sensors 211, valves 213, and/or motors. The user interface 203 to allow the user to monitor the pump(s) 209, lifting apparatus 500, sensors 211, and valves 213, while also providing feedback to a user while the system is in operation. The controller 201 can have a memory that can store one or more pre-determined programs, such as a lifting protocol, level thresholds, and other data, that can further be configured to execute a control algorithm to provide control instructions to a solenoid, valve, amplifier, or other components of the lifting apparatus 500. The controller 201 can include a multi-channel programmable controller or other suitable type of microprocessor that can execute a control algorithm stored in a memory and provide control instructions or signals to the components of the lifting apparatus 500. A hydraulic cylinder 501 of the one or more lifting apparatuses can then be extended or retracted using the controller 201. The controller 201 can include a microprocessor, memory, AD converter, and other suitable components to allow the controller to communicate with the components of one or more lifting apparatuses. The user interface 203 can provide multiple references to a user in real time. As shown in FIG. 13B, the user interface can display a visual indication of the current lifting status and electronic stop, maximum allowable deviance and if it has been exceeded, the flow rate to valves and pumps, target height sensor, operation mode, and the actuation direction of either up or down, among others.

In some exemplary embodiments, the cylinders can be synchronized to lift the roof assembly uniformly into position, such as lifted position. One or more level sensors 211 can be used to monitor the distance above the ground plane at each corner of the roof assembly to ensure that the system is lifting the roof assembly in a uniform manner. In one exemplary embodiment, the sensors 211 can include an analog output laser to translate a distance measurement into a standard signal that is communicated to the controller 201 to determine a distance. Using a logic algorithm, the controller determines which of the points is the highest and lowest and makes adjustments to the output to the amplifiers to decrease the flow to the highest point, and increase the flow to the lowest point, when lifting and lowering the load distributing means. Additionally, the user interface 203 can provide for manual control of each individual valve, lift speed, and output of each valve, as well as the height for each of the sensors 211. The sensors can be communicatively coupled to the controller using any suitable means, such as NFC, Bluetooth, Wi-Fi, or electrically connected using other means.

In some exemplary embodiments, the system can use analog output lasers to translate a distance measurement into a signal to the controller. The controller 201 can then use the signals to proportional valves 213 in order to modify the flow of hydraulic fluid to the cylinders 501. The controller 201 can then use a logic processor to determine the high and low points at various sensors 211, and make adjustments according to the outputs to increase or decrease the flow to the cylinders to maintain a level raising of the roof assembly. The system can operate in one or more modes, including manual and automatic mode. An emergency stop condition can be programmed to prevent all movement in either mode. Each of the pumps 209 can be controlled individually by the controller or simultaneously by a user. The automatic mode allows the controller 201 to determine the high and low points during the lifting stage using the signals from the sensors. The lifting apparatus and load distributing apparatus can be used in tandem as a building elevation system to aid with various building operations including elevating a roof assembly as disclosed herein. The controller and control system can be used to further automate and control the operation of the lifting apparatus of the present disclosure.

Figure 17:
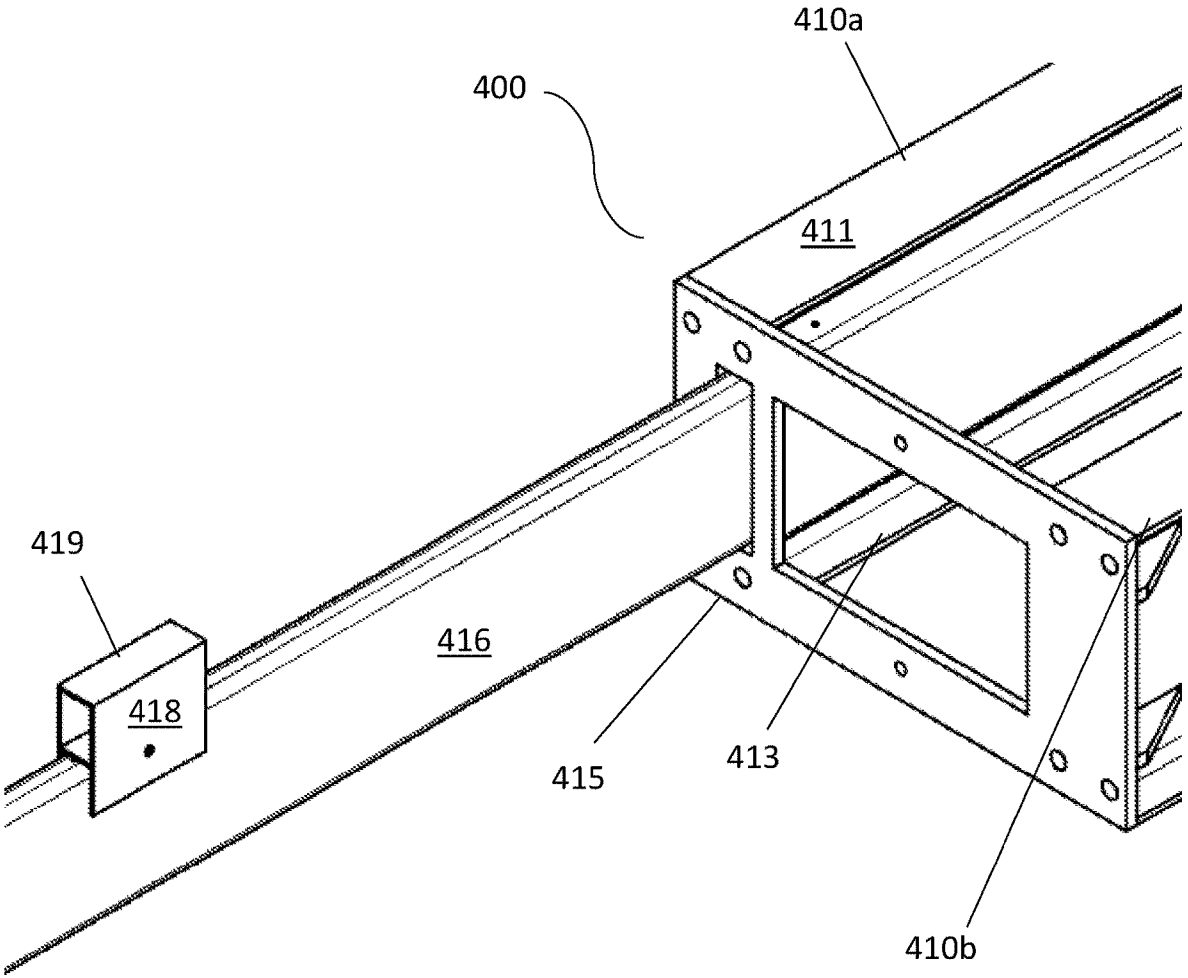
FIG. 17 is an illustration of an exemplary embodiment of a stringer assembly having an A bracket of the present disclosure.

As shown in FIG. 17, an end portion 415 of a load distributing apparatus 400 can further include one or more slidable extension portions 416. The slidable extension portions 416 can extend past the end portion of a load distributing apparatus 400 a pre-determined distance. Additionally, the slidable extension portions 416 can be stored or retracted to not extend past the end portion 415 of the load distributing apparatus 400. The slidable extension portion 416 can further include a spacer bracket 418 that can be removably coupled to a portion of the slidable extension portion 416 of the load distributing apparatus. The spacer 418 can have a top surface 419 that can be on the same plane as the top surface 411 of a load distributing apparatus. This allows the top surface 419 of the bracket 418 to be flush with the top surface 411 of the load distributing apparatus 400.

The slidable extension portion 416 can allow for the length of the load distributing apparatus 400 without the need to couple an additional load distributing apparatus section/segment to extend the length. The spacer bracket 418 can provide a support point for the roof assembly or a part of the roof assembly such as a truss. The bracket 418 can be coupled to the slidable extension portion 416 using any suitable means. If a user desires to fully retract the slidable extension portion 416, the bracket 418 can be removed. In some exemplary embodiments the lateral member 410 can have a recessed portion which can house the slidable extension portion 416. The recessed portion can be formed by the top surface 411 and the bottom surface 413 of the lateral members 410. In some exemplary embodiments, the lateral members 410 can have a central portion between the top surface 411 and the bottom surface 413. The top surface 411 and bottom surface 413 can extend past the central portion and can form a cavity or recess between the top surface 411 and bottom surface 413. The top and bottom surfaces can be formed in any suitable orientation including as a flange. In other exemplary embodiments, various diagonal brace members or supports can be used to provide rigidity to the lateral members as illustrated in FIG. 9A-D. The slidable extension portion can be positioned within the recess of the top surface 411 and bottom surface 413 and/or between the first lateral member and the second lateral member.

Figure 18:
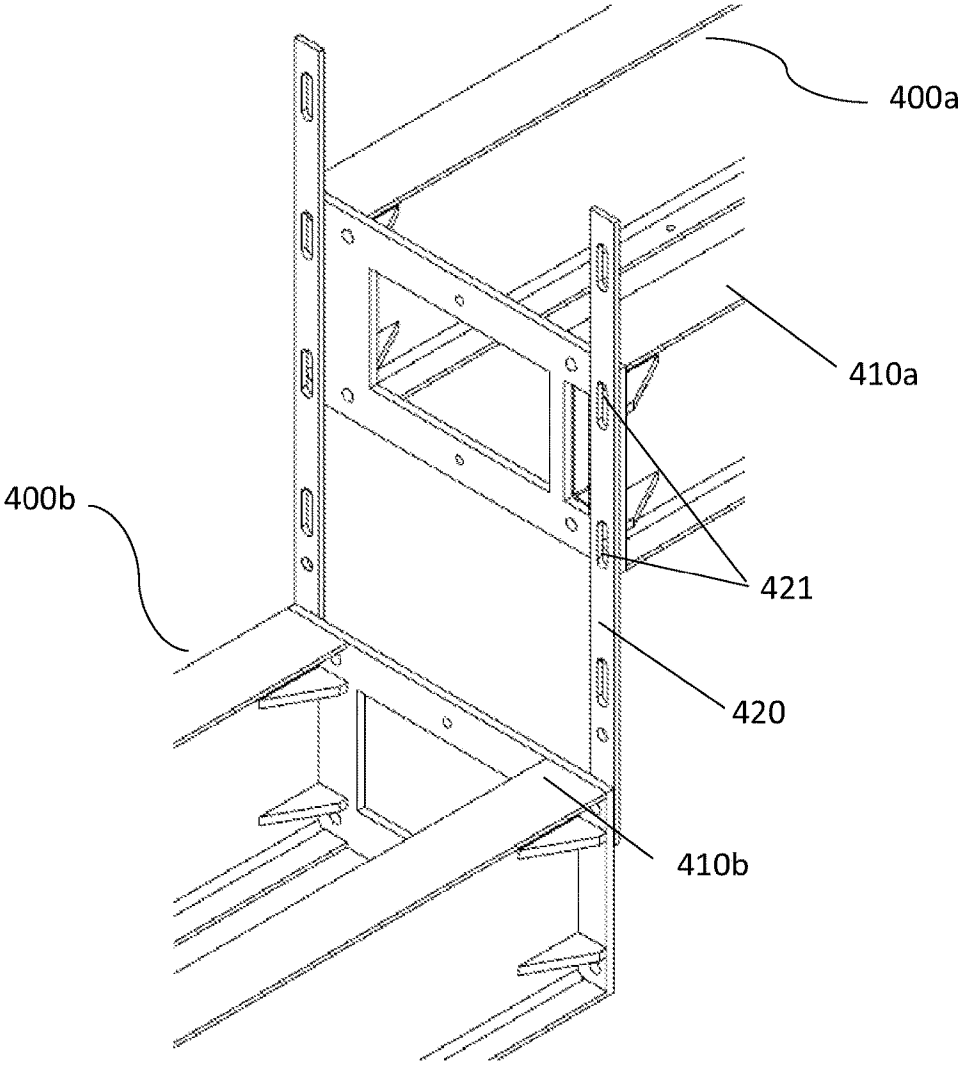
FIG. 18 is an illustration of an exemplary embodiment of a step-down bar assembly of a lifting apparatus of the present disclosure.

FIG. 18 provides for an exemplary embodiment of the load distribution apparatus 400 having a first segment 400*a* and a second segment 400*b*. The two segments can be coupled together at corresponding ends of the segments. In some applications utilizing a roof assembly having one or more building height changes in the roof line or assembly, it may be necessary to have segments that vary in linear planes to accommodate the different height requirements. One or more step-down element 420 can be coupled to the respective ends of the segments 400*a, b*. The step-down bar 420 can have various apertures 421. The various apertures can be spaced along the length of the step-down bar element 420 to allow for great adjustability in height between the top surface of the first segment 410*a* and the top surface 410*b* of the second segment 400*b*. The step-down bar can have a first end and a second end and a first side and a second side. The first side can interface with the end of the first segment 400*a* and the second side can interface with the second segment 400*b*. Each segment can be fastened to the respective side of the step-down bar element 420 using any suitable means. The segments can be fastened along the axis of the step-down bar element 420 as necessary to accommodate the shape and configuration of a roof assembly.

FIGS. 19A-G are exemplary embodiments of a load distributing apparatus for various roof configurations. In some applications, the roof assembly can have a more than just a linear rectangular shape, such as an L-shape, T-shape, or other shape configuration that may require additional supports to accommodate the different orientations of the roof assembly. In some exemplary embodiments, the load distributing apparatus 400 can include additional elements to allow for multiple segments to be coupled at various angles to accommodate different roof assembly configurations.

Figure 19A:
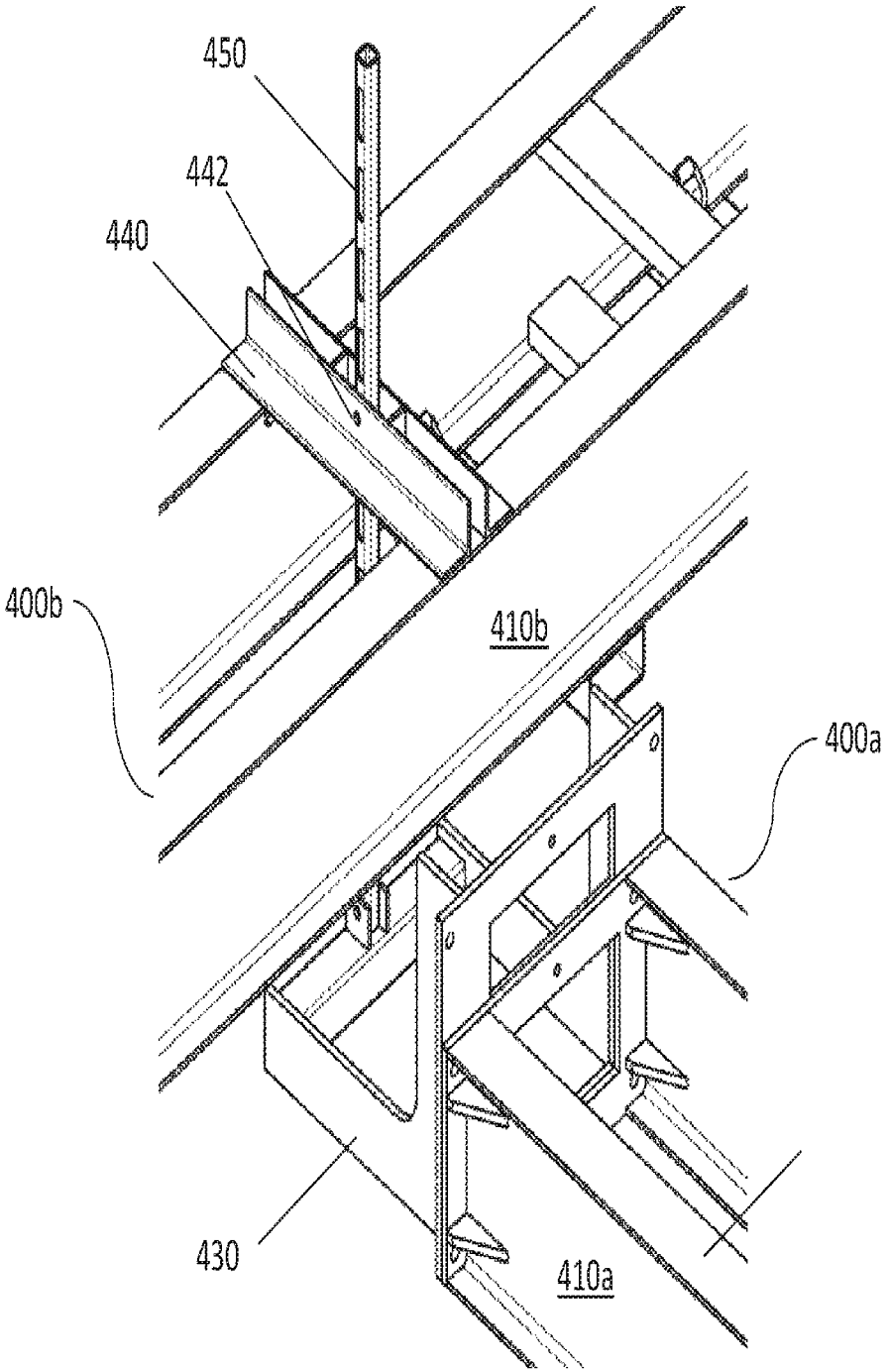
FIG. 19A is a perspective view of an exemplary embodiment of a load distributing apparatus configured to lifting a roof assembly having trusses running various angles on a dual plane.
Figure 19B:
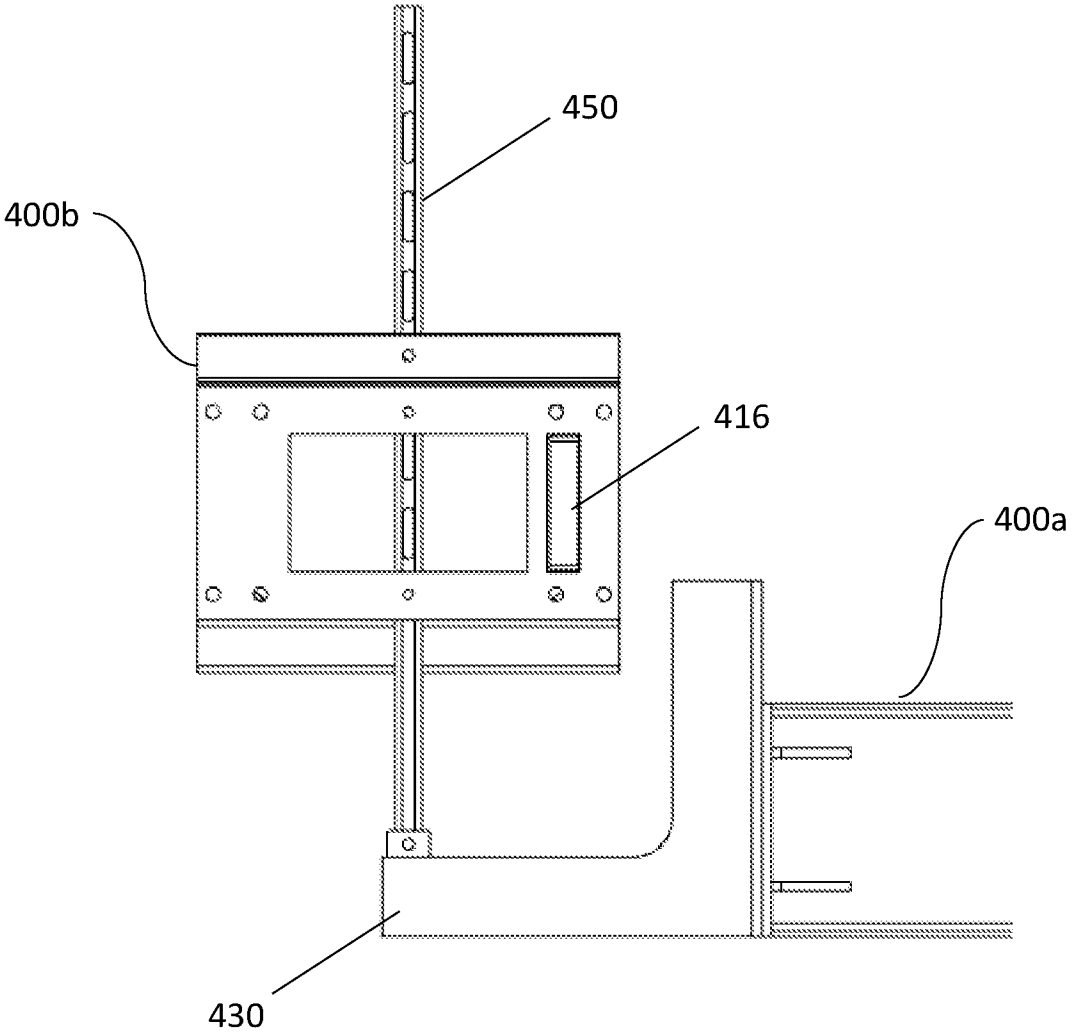
FIG. 19B is side view of an exemplary embodiment of a dual axis load distributing apparatus configured to lifting a roof assembly having trusses running various angles on a dual plane.
Figure 19C:
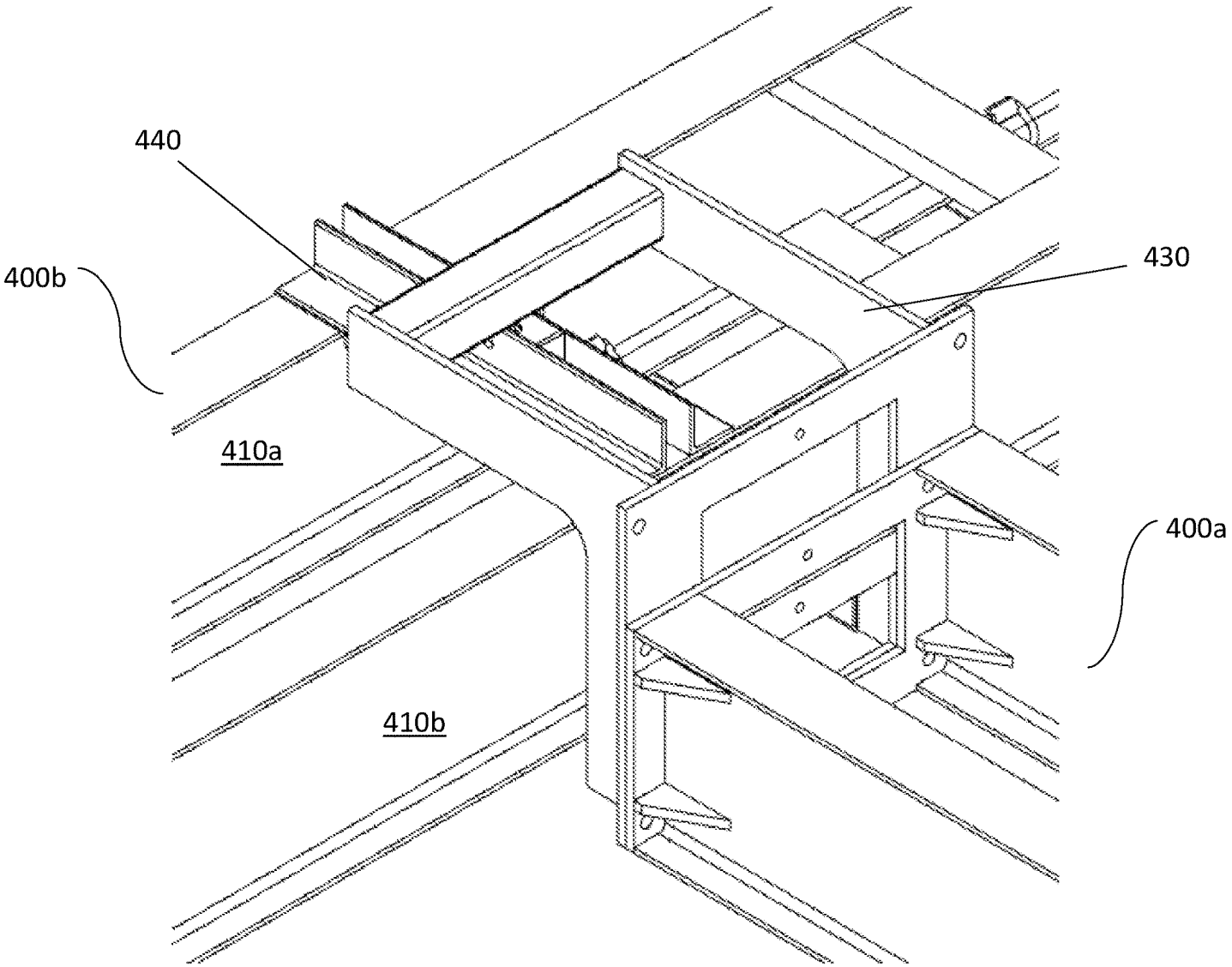
FIG. 19C is a perspective view of an exemplary embodiment of a load distributing apparatus configured to lifting a roof assembly having trusses running various angles on a single plane.
Figure 19D:
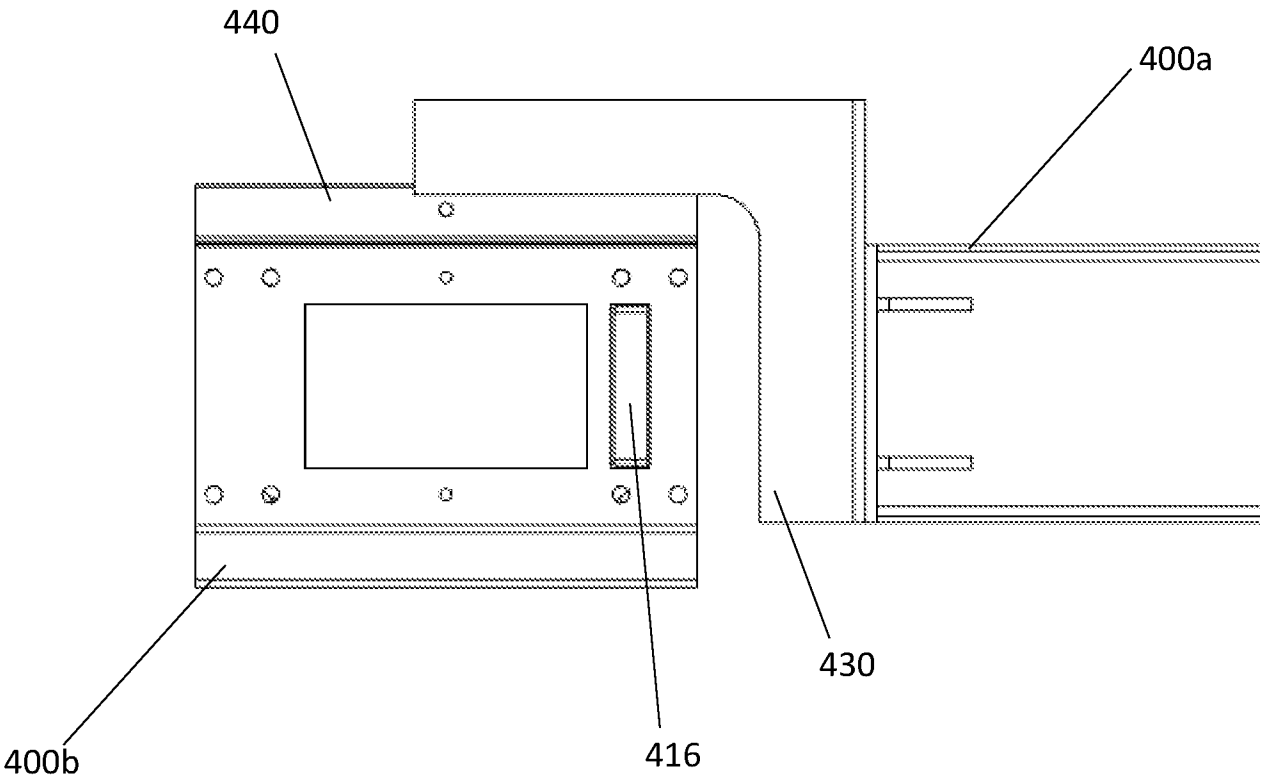
FIG. 19D is side view of an exemplary embodiment of a dual axis load distributing apparatus configured to lifting a roof assembly having trusses running various angles on a single plane.

As shown in FIGS. 19A-B, a dual plane roof assembly application has a multiple angle configuration, and a perpendicular member 430 can be coupled to an end of the first load distributing apparatus element 400*a*. Whereas FIGS. 19C-D, provide a configuration of a load distributing apparatus for a single plane roof assembly having a multiple angle configuration. Various components can be utilized to couple the various segments of the load distributing apparatus together to provide for these various configurations, including but not limited to a perpendicular element 430, a cross-member element 440, and a vertical adjustment member 450. In the dual plane configuration, a perpendicular element 430 can be coupled to an end of the first segment 400*a* and the cross member can be coupled to the second segment 400*b*. A vertical adjustment member 450 can be coupled to the perpendicular element 430 and the cross-member element 440. Based upon the user application and the roof assembly configuration, the vertical adjustment member 450 can be used to allow the top surface of the first segment 400*a* to be at a different plane than the top surface of the second segment 400*b* to allow for the load distributing apparatus to contact the roof assembly having various planes.

In the single plane embodiment illustrated in FIGS. 19C-D, a perpendicular element 430 and cross member element 440 can be utilized. The perpendicular element 430 can be coupled to an end of the first segment 400*a* and the cross member element 440 can be coupled to the second segment 400*b*. The cross member 440 and the adjacent element 430 can be coupled together, allowing for the two segments 400*a,b* to be oriented generally perpendicular to each other as shown in FIG. 19C. Additionally, the top surface of each of the first segment 400*a* and the second segment 400*b* can be on the same plane to evenly contact the roof assembly.

Figure 19E:
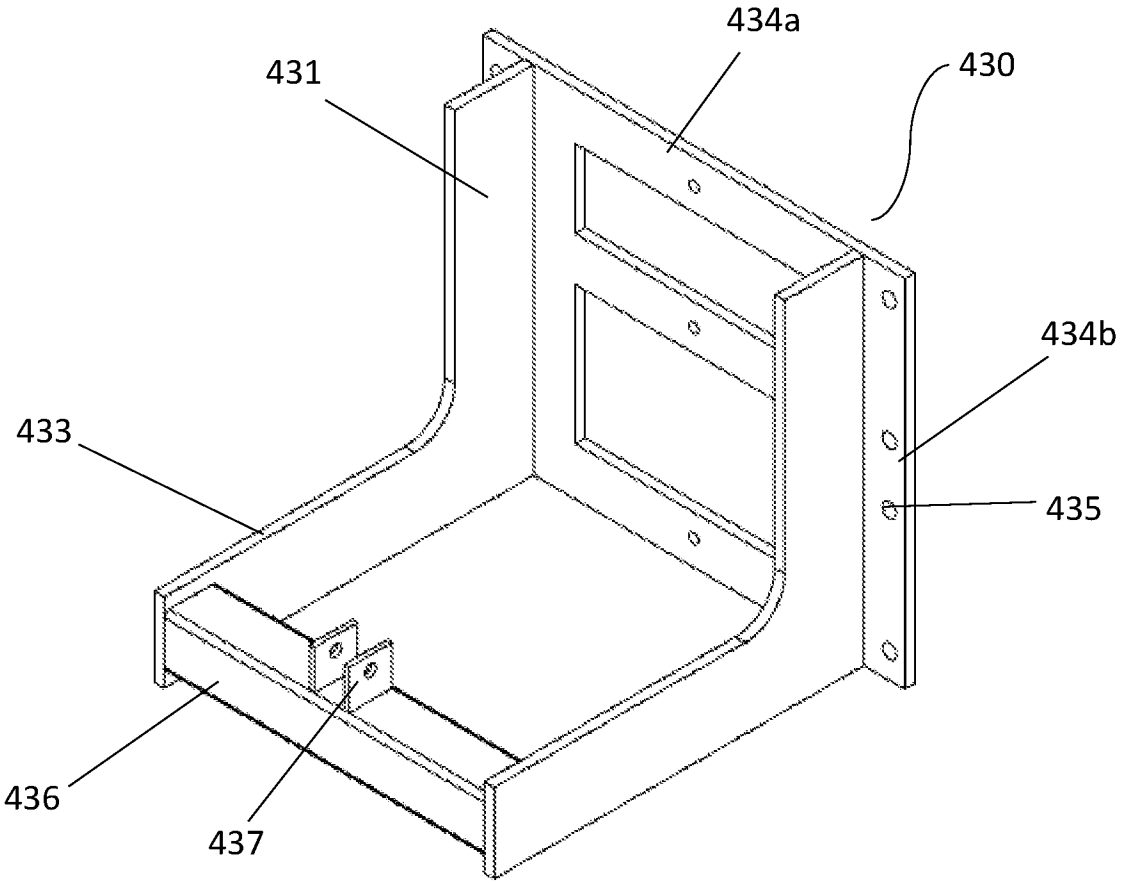
FIG. 19E is a perpendicular frame portion of an exemplary embodiment of a dual axis load distributing apparatus of the present disclosure.

FIG. 19E illustrates an exemplary embodiment of how a perpendicular element 430 can have a first end 431 and a second end 433. The first end can extend along a first plane and the second end can extend along a second plane generally perpendicular to the first end. The first end can have one or more cross members and mounting flanges 434 that can have one or more apertures 435 configured to allow the cross-section member to be removably couplable to a first end of a first load distributing segment using any suitable fastener. The second end has a cross-member 436 which can additionally include one or more mounting points 437.

Figure 19F:
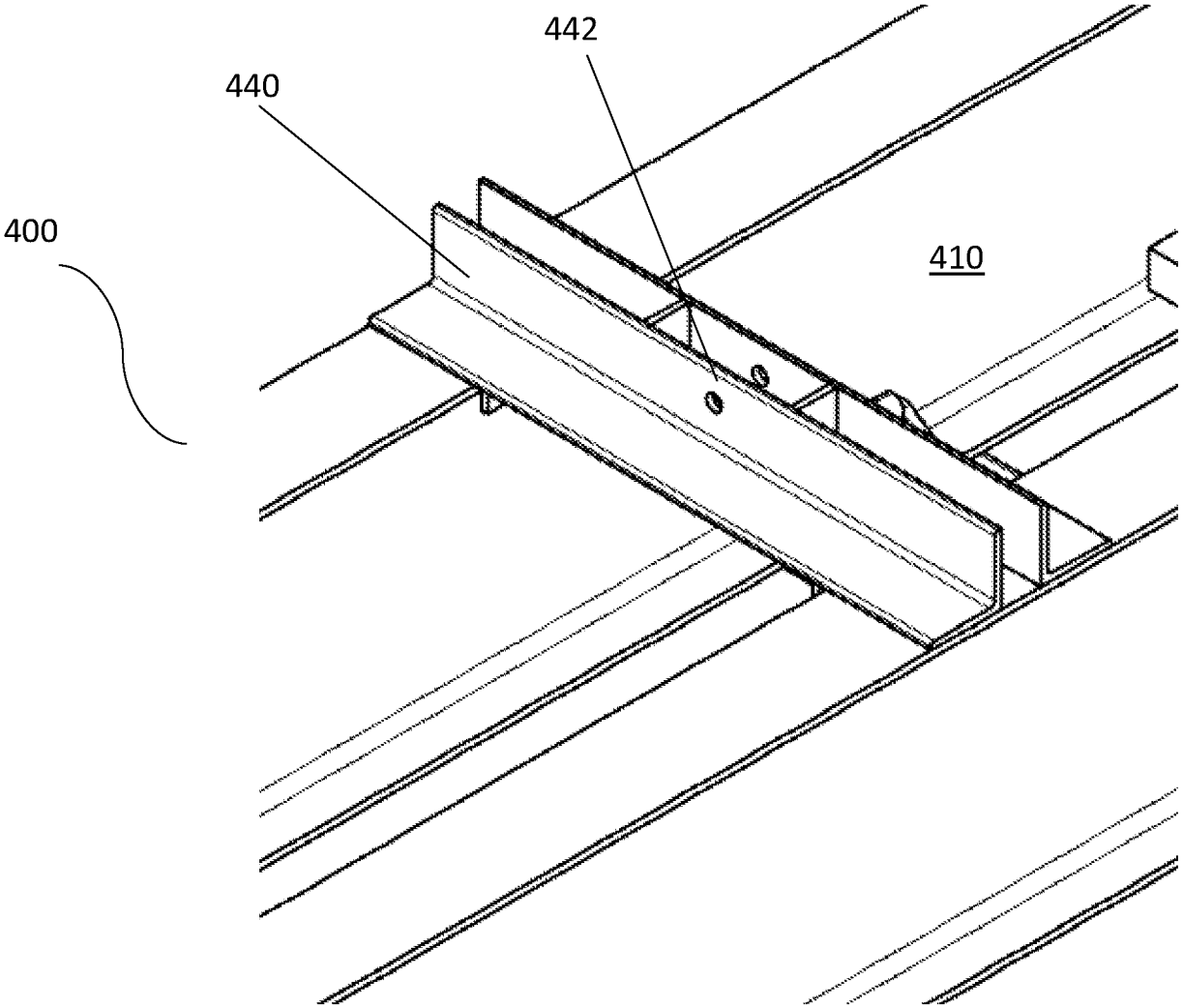
FIG. 19F is cross-member portion of an exemplary embodiment of a dual axis load distributing apparatus of the present disclosure.

FIG. 19F is an exemplary embodiment of a cross-member element 440 that can be removably coupled to the top surface of a second load distributing apparatus element 400*b*. A cross-bar element 440 can be coupled to the top surface of a second load distributing apparatus segment 400*b*. The cross-bar element can rest on the top surface of each of the lateral members 410. The cross-bar element 440 can have one or more mounting points 442 at a predetermined locations. In some exemplary embodiments, a mounting point 442 can be located generally in the center between the two lateral members 410.

Figure 19G:
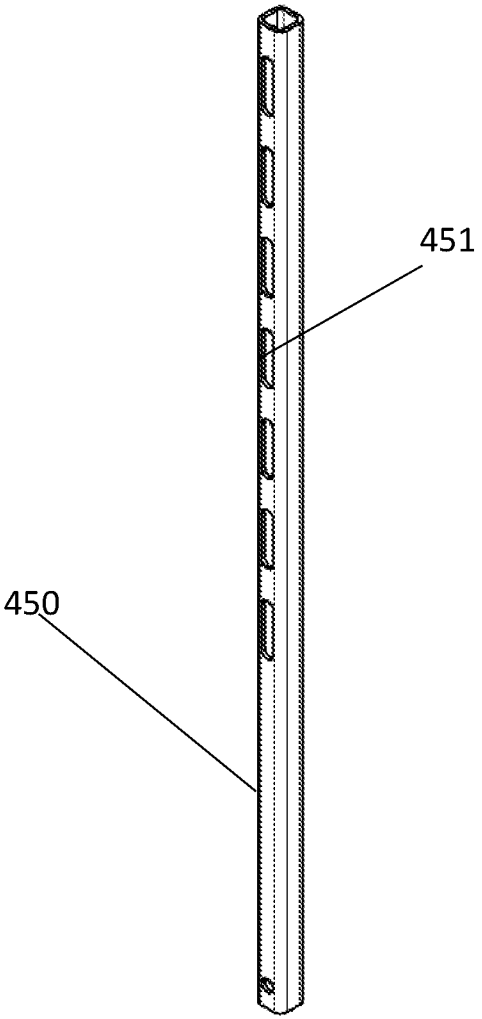
FIG. 19G is a vertical member of an exemplary embodiment of a dual axis load distributing apparatus of the present disclosure.

Additionally, as shown in FIGS. 19B and 19G, a vertical adjustment member 450 having a first end and a second end can be utilized. The vertical adjustment member 450 can have one or more apertures or channels 451 that can be configured to allow the vertical adjustment member to be removably coupled to the cross-bar element 440 and/or the mounting point 437 on the cross-member 436 of the perpendicular member 430 as shown in FIG. 19A. Any suitable fastener can be utilized to couple the components together.

This written description uses examples to disclose various embodiments, including the best mode, and also to enable any person skilled in the art to make and use these embodiments. The patentable scope is defined by the claims and may extend to include other examples not explicitly listed that occur to those skilled in the art. Such other examples are intended to be within the scope of the claims if they have structural elements that do not differ from the literal language of the claim, or if they include equivalent elements with insubstantial differences from the literal language of the claims.

Various alternatives and embodiments are contemplated as being within the scope of the following claims, particularly pointing out and distinctly claiming the subject matter of the present disclosure.

What is claimed is:

1. A roof assembly comprising:

a plurality of top members, wherein the roof assembly is fully assembled at a first position and is configured to be removably couplable to a plurality of ground-mounted stubs supporting the plurality of top members; and a support assembly fully assembled at the first position, wherein the support assembly includes one or more columns having a top end and a bottom end, wherein the support assembly is hingedly coupled to a portion of the top members of the roof assembly, wherein the support assembly can pivotably rotate downward around an edge of the roof assembly and under the roof assembly when the roof assembly is lifted from the first position to a second position;

wherein each of the one or more columns has a corresponding stub of the plurality of stubs, and wherein the plurality of top members are configured to be removably couplable to the stubs when the roof assembly is in the first position, wherein the top members are further configured to be removably couplable to the top end of the columns of the support assembly and the bottom end of the columns are configured to be coupled to the corresponding stub of the plurality of stubs stubs when the roof assembly is in the second position and the support assembly has rotated underneath the roof assembly.

2. The assembly of claim 1, wherein each of the plurality of top members correspond to one of the plurality of stubs.

3. The assembly of claim 1, wherein the first position is a lowered position and the second position is a raised position.

4. The assembly of claim 3, wherein the roof assembly further comprises a removeable safety net system, wherein the removable safety net system includes a net and a tensioning means, wherein the safety net system is installed when the roof assembly is in the first position.

5. The assembly of claim 4, wherein the safety net system further comprises a support member having a proximate end and a distal end, wherein the proximate end is coupled to the stub, and wherein the net is positioned between the distal end of the support member and the roof assembly.

6. The assembly of claim 5, wherein the tensioning means can be coupled to a portion of the net, wherein the tensioning means is configured to maintain the net in a taut configuration between the support member and the roof assembly.

7. The assembly of claim 1, wherein the support assembly includes a hinge configured to be removably couplable to a portion of the roof assembly.

8. The assembly of claim 7, wherein the columns of the support assembly can further include one or more girts.

9. The assembly of claim 8, wherein the support assembly can further include exterior sheathing coupled to the girts of the support assembly.

10. The assembly of claim 7, wherein the top members have a first end and a second end, wherein the first end of the top members can have a recess portion configured to interface with an extension end formed at the respective column or stub.

11. The assembly of claim 10, wherein extension portions of the stubs are configured to interface with the recess portion of the top members when the roof assembly is at a first position.

12. The assembly of claim 11, wherein the extension ends of the columns are configured to interface with the recess portion of the top members when the roof assembly is at a second position.

13. The assembly of claim 1, wherein each of the one or more columns includes a hinge at the top end configured to be removably couplable to a portion of the top members.

14. The assembly of claim 1 wherein the plurality of stubs are ground-mounted stubs.

15. The assembly of claim 14 wherein the ground-mounted stubs extend up from the ground a predetermined distance.

16. The assembly of claim 15 further comprising a load distributing apparatus engaging a lifting apparatus configured to lift the roof assembly from the first position to the second position, the load distributing apparatus and the lifting apparatus positioned under the roof assembly and above at least a portion of the ground-mounted stubs when the roof assembly is in the first position, the load distributing apparatus configured to engage the roof assembly when the roof assembly is lifted from the first position to the second position.

17. The assembly of claim 16 wherein the lifting apparatus includes a plurality of level sensors in communication with a controller, wherein the controller is configured to maintain the load distributing apparatus in a level position when the roof assembly is moved from the first position to the second position.

18. The assembly of claim 16 further comprising a plurality of braces configured to support the roof assembly when the roof assembly is moved from the first position to the second position.

19. A method of assembling a building comprising:

assembling a roof assembly at a lowered position with a plurality of top members of the roof assembly removably coupled to a plurality of ground-mounted stubs, wherein the roof assembly is positioned over a load distributing apparatus and a lifting apparatus configured to raise the load distributing apparatus;

moving the load distributing apparatus into engagement with the roof assembly and moving the roof assembly from the lowered position toward a raised position;

allowing a support assembly to pivotably rotate downward around an edge of the roof assembly and under the roof assembly as the roof assembly is lifted from the lowered position toward the raised position, the support assembly including one or more columns having a top end and a bottom end, wherein the support assembly is hingedly coupled to a portion of the plurality of top members of the roof assembly; and when the roof assembly is in the raised position, coupling the top end of each of the one or more columns of the support assembly to the plurality of top members of the roof assembly, and coupling the bottom end of each of the one or more columns of the support assembly to the plurality of ground-mounted stubs.

* * * * *